US012779355B2

(12) United States Patent
Shear

(10) Patent No.: US 12,779,355 B2
(45) Date of Patent: Nov. 3, 2026

(54) CHILDRENS ACTIVITY TABLE

(71) Applicant: Fred H. Shear, Metairie, LA (US)

(72) Inventor: Fred H. Shear, Metairie, LA (US)

( * ) Notice: Subject to any disclaimer, the term of this patent is extended or adjusted under 35 U.S.C. 154(b) by 0 days.

(21) Appl. No.: 19/172,378

(22) Filed: Apr. 7, 2025

(65) Prior Publication Data

US 2025/0242273 A1 Jul. 31, 2025

Related U.S. Application Data

(62) Division of application No. 18/942,702, filed on Nov. 10, 2024.

(51) Int. Cl.
*A63H 33/04* (2006.01)
*A47B 25/00* (2006.01)

(52) U.S. Cl.
CPC ..... *A63H 33/04* (2013.01); *A47B 25/00* (2013.01)

(58) Field of Classification Search
CPC ..... A47B 25/00
See application file for complete search history.

(56) References Cited

U.S. PATENT DOCUMENTS 110,013 A * 12/1870 Congle ..... A47B 13/021 248/188
360,712 A * 4/1887 McLain ..... A47B 13/021 248/188
1,533,724 A * 4/1925 Clarke-James ..... E04B 1/2604 403/381
1,537,459 A * 5/1925 Campbell ..... F16B 12/22 403/231
1,850,420 A * 3/1932 Schuldt ..... A63F 1/06 273/284
2,793,407 A * 5/1957 Johnston ..... F16B 12/20 403/182

(Continued)

FOREIGN PATENT DOCUMENTS

CN 213247984 U * 5/2021
GB 2490544 A * 11/2012 ..... A63H 18/00
KR 20080010893 A * 1/2008 ..... A47B 13/021

OTHER PUBLICATIONS

Translation CN213247984U (Year: 2021).*

*Primary Examiner* — Eugene L Kim
*Assistant Examiner* — Alyssa M Hylinski
(74) *Attorney, Agent, or Firm* — Taylor M. Norton; Norton IP Law Firm LLC

(57) ABSTRACT

A childrens activity table includes a pair of u-shaped legs, each having elongated mounting plates fixed to a respective surface of the u-shaped legs. A first apron and a second apron each include elongated apron plates having respective elongated annular rails spaced apart in a non-parallel orientation forming respective annular pockets at the ends of the first and second aprons, which are adapted to slidably receive the elongated mounting plates of the respective u-shaped legs, providing for an assembly of the childrens activity table without a need for tools. Another childrens activity table includes at least one leg having an elongated mounting plate that forms an annular pocket, and an apron corner support bracket that connects a first apron to a second apron includes an elongated mounting plate that forms an annular mounting bracket configured to slidably engage the annular pocket, providing for an upstanding table position, without tools.

10 Claims, 27 Drawing Sheets

(56) References Cited

U.S. PATENT DOCUMENTS

| | | | | | |
|---|---|---|---|---|---|
| 3,533,363 | A * | 10/1970 | Reiss | A47B 13/06 | 108/153.1 |
| 3,683,429 | A * | 8/1972 | Mis | A47C 19/024 | 5/300 |
| 5,055,081 | A * | 10/1991 | Nayak | A63H 33/04 | 108/26 |
| 5,327,838 | A * | 7/1994 | Beltman | A47B 25/00 | 108/26 |
| 5,332,289 | A * | 7/1994 | Nottingham | F16B 12/24 | 297/440.1 |
| 5,615,619 | A * | 4/1997 | King | A47B 25/00 | 312/285 |
| 5,622,120 | A * | 4/1997 | Yeh | A47B 13/021 | 108/158 |
| 5,860,759 | A * | 1/1999 | Leicht | A47B 87/002 | 5/9.1 |
| 6,200,062 | B1 * | 3/2001 | You | F16B 12/20 | 403/381 |
| 6,595,143 | B2 * | 7/2003 | London | A47D 3/00 | 108/25 |
| 6,662,732 | B2 * | 12/2003 | Birsel | A47B 21/00 | 108/26 |
| 7,066,298 | B1 * | 6/2006 | Mackinnon | A47B 96/061 | 182/92 |
| 10,508,674 | B2 * | 12/2019 | Harrow | F16B 12/20 | |
| 11,118,617 | B1 * | 9/2021 | Isensee | F16B 12/50 | |
| 2004/0098943 | A1 * | 5/2004 | Turner | E04B 1/003 | 52/713 |
| 2005/0077678 | A1 * | 4/2005 | Bibi | A63F 3/00895 | 273/284 |
| 2017/0276158 | A1 * | 9/2017 | Cardinal | F16B 7/02 | |

* cited by examiner

CHILDRENS ACTIVITY TABLE

CROSS-REFERENCE TO RELATED APPLICATIONS

This application is a divisional continuation of co-pending and commonly owned U.S. application Ser. No. 18/942,702, filed on Nov. 10, 2024, the full disclosure of which is hereby incorporated herein by reference in its entirety and priority of which is hereby claimed.

BACKGROUND OF THE INVENTION

Field of the Invention

The present invention relates generally to activity tables, and more particularly, to a childrens activity table assembled without any need for any tools or loose hardware.

Description of the Related Art

Many children use activity tables for learning and recreational activities. Oftentimes such childrens activity tables are difficult to assemble in light of the multitude of component parts and the gauntlet of tools required by a user to assemble the respective childrens activity table.

Interlocking building blocks and other toys of the type sold under the trademarks DUPLO, LEGO, MEGA BLOKS and PLAYMOBIL have for many years been a popular children's toy. Because such blocks are excellent teaching tools, it is desirable to encourage children to play with them, and to that end, products have been sold under the mark TABLE TOYS since 1989, for example, which is intended to provide such encouragement. That product includes a childrens activity table with plates inset into the top thereof having projections for interdigitating with such building blocks molded therein so that the children are encouraged to erect various structures on the table top with those blocks, using the projections on the plates of these tables to stabilize the structure on the table. Of course such blocks also have a habit of disappearing and/or constantly being under foot, and so the product sold under the mark TABLE TOYS has long been provided with a cutout in the center of the table surface having a bag attached to the table underneath that cutout for storing the interlocking building blocks. This product has enjoyed considerable success and acceptance in the marketplace. However, the childrens activity tables of the sort are not easily transportable nor easy to ship when fully assembled, in the sense that they are not easily transportable from place to place. As a result, such childrens activity tables must be shipped or transported as component parts, which oftentimes proves difficult for users to assemble, requiring a multitude of tools and requiring users to expend and waste a lot of time in the process.

Therefore, it is desirable to provide a childrens activity table that is easily transportable and also easy to assemble, and particularly, to provide a childrens activity table that does not require any tools or loose hardware for assembly. These and other needs are which the devices of the present invention are directed.

Specifically, an object of the present invention is to provide a childrens activity table preferably for interlocking building blocks that is easy to transport and easy to assemble, with need for any tool and without expensive cost of manufacture.

Other objects, and the advantages of the present invention, will be apparent to those skilled in the art from the following description of the presently disclosed embodiments thereof.

SUMMARY OF THE INVENTION

The following presents a simplified summary of the present disclosure in a simplified form as a prelude to the more detailed description that is presented herein.

In accordance with embodiments of the invention, there is provided a children's activity table having a first u-shaped leg and a second u-shaped leg. The first u-shaped leg has an inner surface opposite an outer surface. The inner surface preferably includes a first elongated mounting plate and a second elongated mounting plate.

In a preferred embodiment, the first and second elongated mounting plates each have a first elongated annular rail spaced apart in a non-parallel orientation to a second elongated annular rail, respectively. The first elongated annular rail and the second elongated annular rail of the respective the first and second elongated mounting plates form respective mounting brackets.

The second u-shaped leg has an inner surface opposite an outer surface. The inner surface comprises a third elongated mounting plate and a fourth elongated mounting plate. The third and fourth elongated mounting plates each have a first elongated annular rail spaced apart in a non-parallel orientation to a second elongated annular rail, respectively. The first elongated annular rail and the second elongated annular rail of the third and fourth elongated mounting plates of the second u-shaped leg each form a respective mounting bracket on the second u-shaped leg each.

The childrens activity table preferably includes a first apron and a second apron. The first apron has a first end opposite a second end. The first end comprises a first elongated apron plate, and the second end comprises a second elongated apron plate.

The first and second elongated apron plates of the first apron and of the second apron, respectively, each have respective elongated annular rails, spaced apart in a non-parallel orientation forming a first annular pocket and a second annular pocket, respectively, on the ends of the first and second elongated apron plates.

The first annular pocket and second annular pocket of the first elongated apron plate and of the second elongated apron plates are each configured to be slidably and removably engaged with the respective mounting brackets of the u-shaped legs when the childrens activity table is in a standing position.

In a preferred embodiment, the first apron has an outer wall opposite an inner wall, where the outer wall has a height that is greater than a height of the inner wall. As described in further detail below, such difference in height provides for an inset that is adapted for receipt of a table top inset at a top of the first apron and second apron of the childrens activity table.

In one embodiment of the children's activity table, the first apron includes an outer wall opposite an inner wall, where the outer wall has a length that is greater than a length of the inner wall. As described in further detail below, such difference in length provides for flush mount between the aprons and the u-shaped legs.

In one embodiment, the inner wall of the first apron has a first mounting end surface opposite a second mounting end surface; the first elongated apron plate is disposed on the first mounting end surface, and the second elongated apron plate is disposed on the second mounting end surface.

In a preferred embodiment, the first elongated apron plate is oriented opposite the second elongated apron plate.

In one embodiment, the first u-shaped leg of the childrens activity table includes a horizontal support member disposed on the inner surface of the first u-shaped leg. The horizontal support member is adapted to receive and support an edge of the table top when the childrens activity table is in the upstanding position (aka, the standing position).

The table top preferably comprises a planar body that is sized and configured to slidably and removably engage the first u-shaped leg, the second u-shaped leg, and the first apron in the standing position. The planar body that is preferably sized and configured to slidably and removably engage the first u-shaped leg, the second u-shaped leg, the first apron, and the second apron, in the standing position. In such manners, a portion of the planar body (e.g., the edge) of the table top is removably engaged atop the horizontal support member of the u-shaped leg.

In a preferred embodiment, the planar body of the table top defines an opening that is adapted to receive children's play toys therethrough.

The childrens activity table preferably includes a storage net that is removably connected to a bottom surface of the planar body of the table top, and the storage net is preferably disposed beneath the opening, where the storage net is adapted to receive and contain the children's play toys that pass through the opening of the table top and into the storage net. In a preferred embodiment, at least one elongated support member holds the storage net to the bottom surface of the table top. In another preferred embodiment, at least two elongated support members hold the storage net to the bottom surface of the table top.

In one embodiment, the table top of the childrens activity table has a top playing surface that contains a plurality of knobs, with each knob projecting perpendicularly from the top playing surface. The plurality of knobs are preferably sized and adapted for mating with interconnecting play toys of the children's play toys.

In another embodiment, the childrens activity table includes a storage bin that is removably connected to a bottom surface of the planar body of the table top. The storage bin is disposed beneath the opening, where the storage bin is adapted to receive and contain the children's play toys that pass through the opening of the table top. In such embodiment, the table top has a top playing surface that has a plurality of knobs projecting perpendicularly from the top playing surface, and the plurality of knobs are adapted for mating with interconnecting toys of the children's play toys.

In a preferred embodiment, the first apron has an outer wall opposite an inner wall, wherein the outer wall has a height that is greater than a height of the inner wall, and the planar body of the table top is removably disposed atop the inner wall of the first apron in the standing position. In such embodiment, the planar body is sized and configured to slidably and removably engage with the first u-shaped leg, the second u-shaped leg, and the first apron in the standing position.

In accordance with other embodiments of the invention, there is provided a children's activity table comprising at least a first leg having a first side surface that is perpendicular to a second side surface, where the first side surface comprises a first elongated mounting plate, and the second side surface comprises a second elongated mounting plate.

In one embodiment, the first and second elongated mounting plates each respectively have a first elongated annular rail spaced apart in a non-parallel orientation to a second elongated annular rail, which respectively form a first annular pocket on the first side surface of the at least first leg and a second annular pocket on the second side surface of the at least first leg.

In one embodiment, the childrens activity table includes at least a first apron having at least a first elongated apron plate, which has a pair of elongated annular rails spaced apart in a non-parallel orientation forming a first annular apron mounting bracket on the at least first apron. In such embodiment, the first annular apron mounting bracket, which is formed by the at least a first elongated apron plate, is sized and configured to slidably engage into the first annular pocket of the at least first leg in an upstanding table position.

In a preferred embodiment, the childrens activity table includes at least a second apron having at least a second elongated apron plate, and the at least second elongated apron plate has a pair of elongated annular rails spaced apart in a non-parallel orientation, which forms a second annular apron mounting bracket. In such preferred embodiment, the second annular apron mounting bracket is sized and configured to slidably engage into the second annular pocket of the at least second leg in the upstanding table position. In such embodiment, the table top includes a planar body disposed atop the at least first apron and atop the at least second apron in the upstanding table position. In one embodiment, the childrens activity table includes a table top having a planar body that is removably connected to the at least first apron and is removably connected to the at least second apron.

In a preferred embodiment, the childrens activity table includes a table top having a planar body that is fixed to a top of the at least first apron and that is fixed to a top of the at least second apron.

In another preferred embodiment, the planar body of the table top of the childrens activity table defines an opening that is adapted to receive children's play toys therethrough. In one embodiment the children's activity table includes a storage net that is removably connected to a bottom surface of the table top, where the storage net is preferably disposed beneath the opening, such that the storage net is adapted to receive and contain children's play toys that pass through the opening of the table top.

In another embodiment, the childrens activity includes a storage bin that is removably connected to a bottom surface of the table top, and the storage bin is preferably disposed beneath the opening, such that the storage bin is adapted to receive and contain children's play toys that pass through the opening of the table top.

In a preferred embodiment, the table top of the children's activity table has a top playing surface that has a plurality of knobs projecting perpendicularly from the top playing surface, and the plurality of knobs are adapted for mating with interconnecting toys.

In another embodiment, the table top has a smooth top playing surface, without a plurality of knobs. In yet another embodiment, the table top has a top playing surface where a portion of the top playing surface is smooth and a separate portion of the top playing surface includes a plurality of knobs projecting perpendicularly from the top playing surface, and the plurality of knobs are adapted for mating with interconnecting toys.

In a preferred embodiment, the planar body of the table top of the childrens activity table defines at least two openings, and each opening of the at least two openings is adapted to receive children's play toys therethrough.

In accordance with other embodiments of the invention, there is provided a children's activity table comprising at least a first leg having a first side surface perpendicular to a second side surface at a first corner, and the first corner comprises a first elongated mounting plate. In such embodiment, the first elongated mounting plate has a first elongated annular rail spaced apart in a non-parallel orientation to a second elongated annular rail, and the first elongated annular rail and the second elongated annular rail form an annular pocket at the first corner of the at least first leg.

In a preferred embodiment, the childrens activity table includes a first apron that is disposed perpendicular to a second apron. The childrens activity table includes an apron corner support bracket having a first end opposite a second end. The first end of the apron corner support bracket is fixed to the first apron. The second end of the apron corner support bracket is fixed to the second apron. The apron corner support bracket has an outer surface that is opposite an inner surface, and the apron corner support bracket includes an elongated mounting plate disposed on the outer surface.

In such preferred embodiment, the elongated mounting plate has elongated annular rails spaced apart in a non-parallel orientation, and the elongated annular rails form an annular mounting bracket that is configured sized and configured to slidably engage into the annular pocket of the first corner of the at least first leg, for an upstanding table position.

In one embodiment, the childrens activity table includes a table top having a planar body that is removably connected to the first apron and that is removably connected to the second apron. In a preferred embodiment, the childrens activity table includes a table top having a planar body that is fixed to the first apron and that is fixed to the second apron.

In a preferred embodiment, the planar body of the table top of the children's activity table has a top surface that is in coplanar alignment with a top surface of the first apron and is in coplanar alignment with a top surface of the second apron.

The planar body of the table top preferably defines an opening that is adapted to receive children's play toys therethrough.

In a preferred embodiment, the children's activity table includes a storage net that is removably connected to a bottom surface of the table top, and the storage net is preferably disposed beneath the opening, such that the storage net is adapted to receive and contain the children's play toys that pass through the opening of the table top and into the storage net.

In another embodiment, the childrens activity table includes a storage bin that. is removably connected to a bottom surface of the table top, and the storage bin is preferably disposed beneath the opening, such that the storage bin is adapted to receive and contain the children's play toys that pass through the opening of the table top and into the storage bin.

In a preferred embodiment, the table top of the childrens activity table includes a top playing surface having a plurality of knobs projecting perpendicularly from the top playing surface, and the plurality of knobs is adapted for mating with interconnecting toys.

In a preferred embodiment, the childrens activity table includes a table top having a planar body that defines at least two openings, and each opening is adapted to receive children's play toys therethrough.

In another embodiment, the table top of the childrens activity table has a smooth top playing surface.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which.

DETAILED DESCRIPTION

Figure 1:
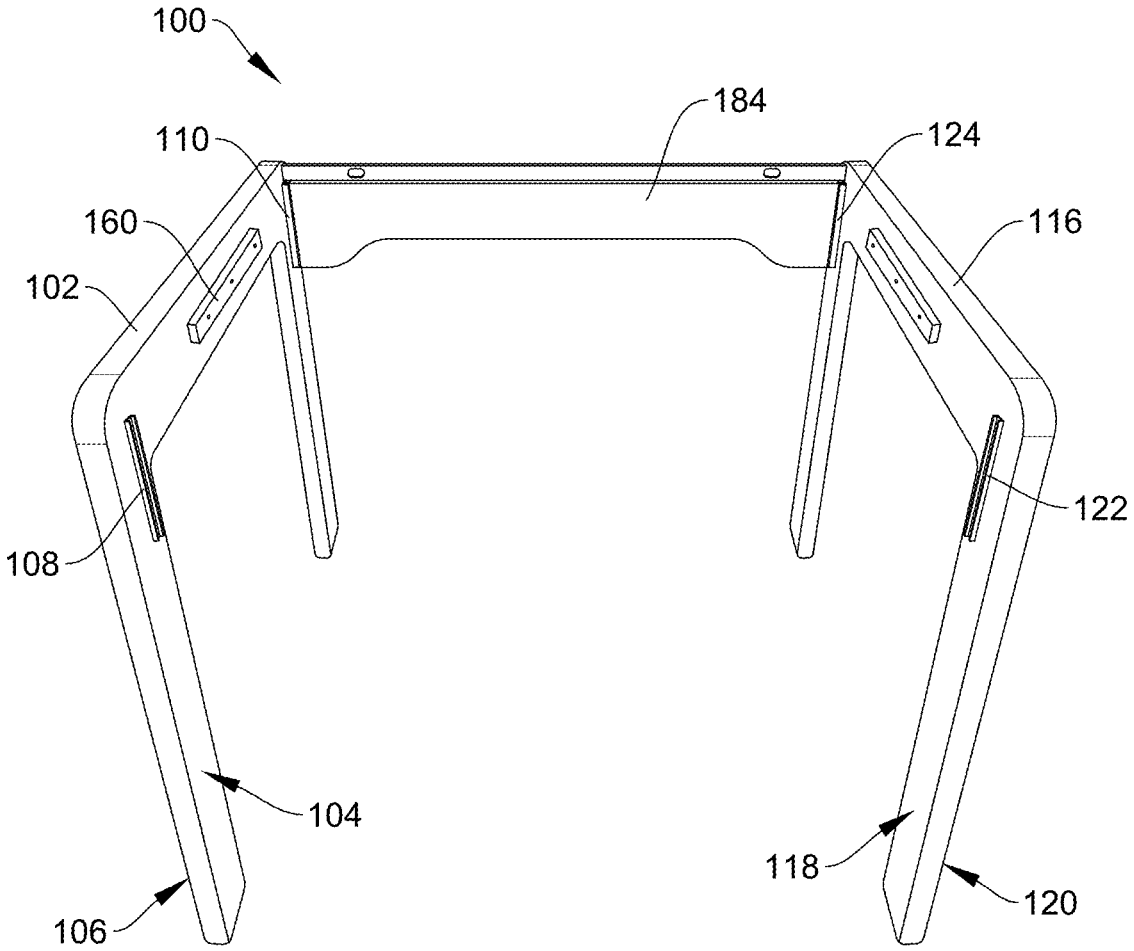
FIG. 1 illustrates a front perspective view of a childrens activity table, in accordance with embodiments of the invention.

For a further understanding of the nature and function of the embodiments, reference should be made to the following detailed description. Detailed descriptions of the embodiments are provided herein, as well as the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

Reference will now be made in detail to the present preferred embodiments of the invention, examples of which are illustrated in the accompanying drawings. Wherever possible, the same reference numerals are used in the drawings and the description to refer to the same or like parts.

Figure 3:
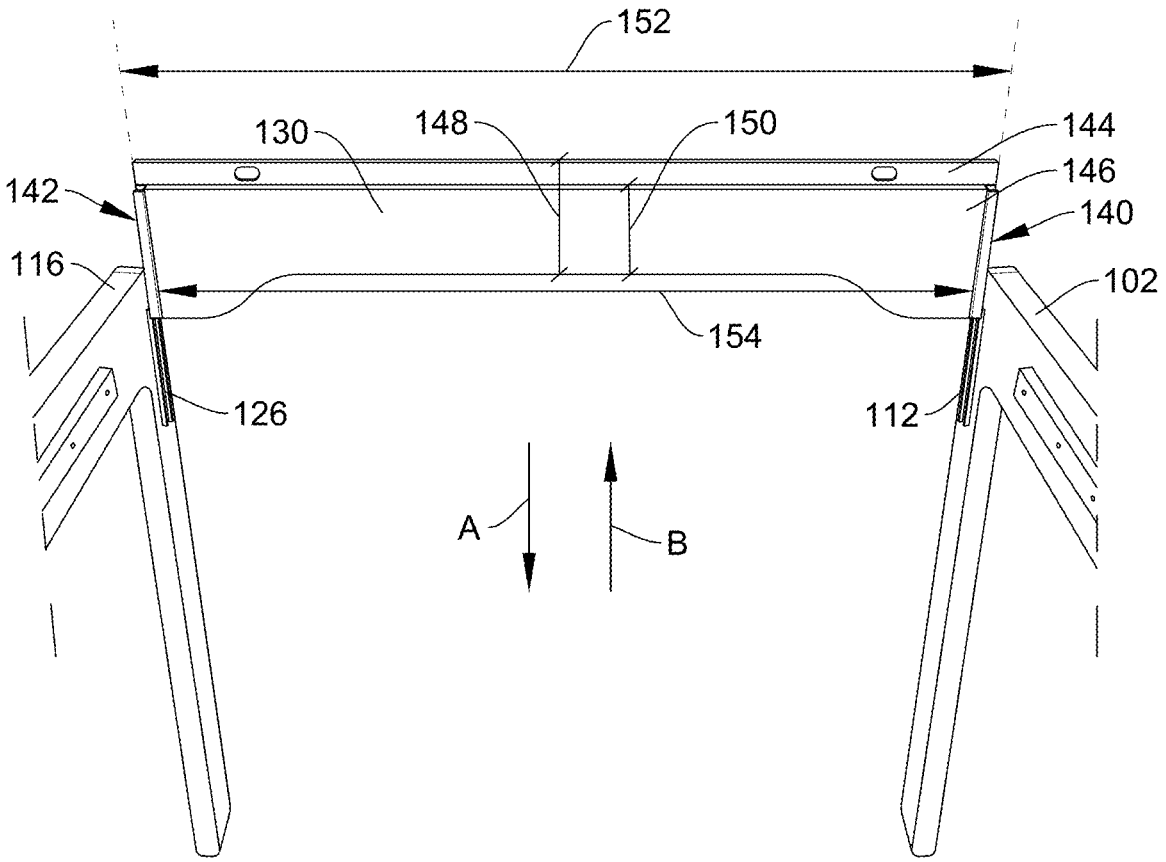
FIG. 3 illustrates a back perspective partial view of the childrens activity table, in accordance with embodiments of the invention.
Figure 4:
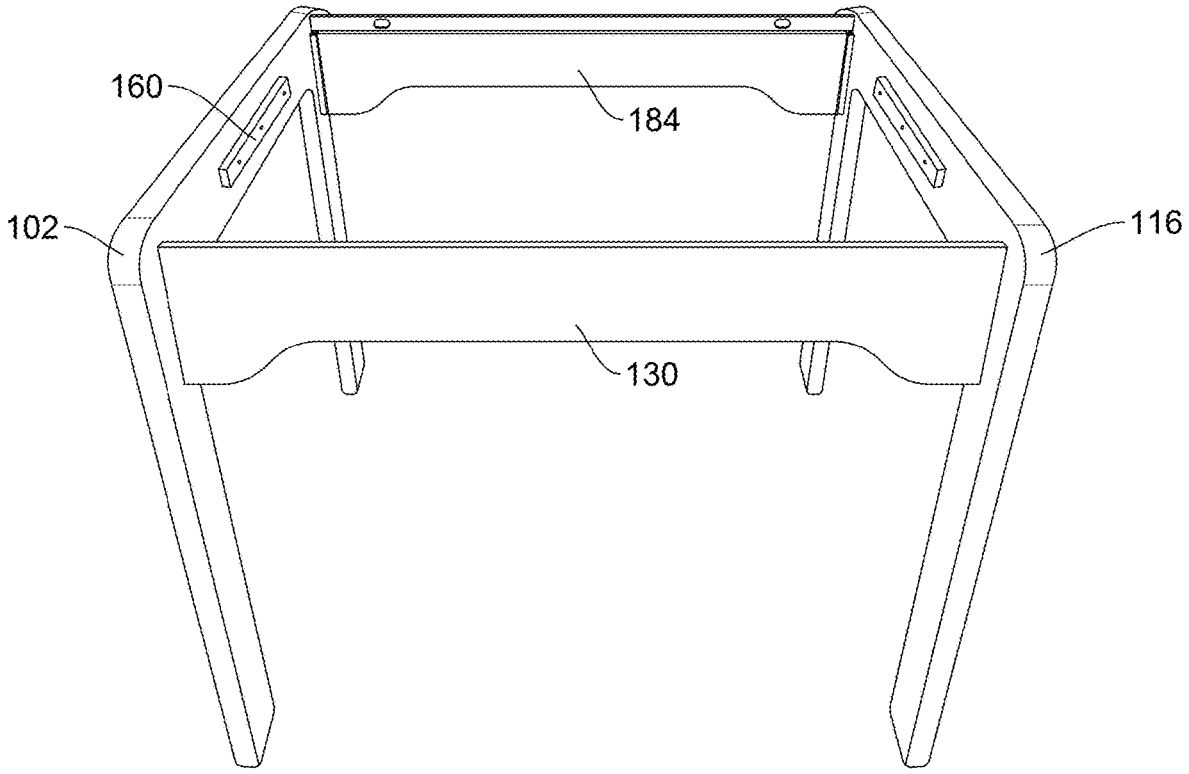
FIG. 4 illustrates a front perspective view of the childrens activity table, in accordance with embodiments of the invention.
Figure 5:
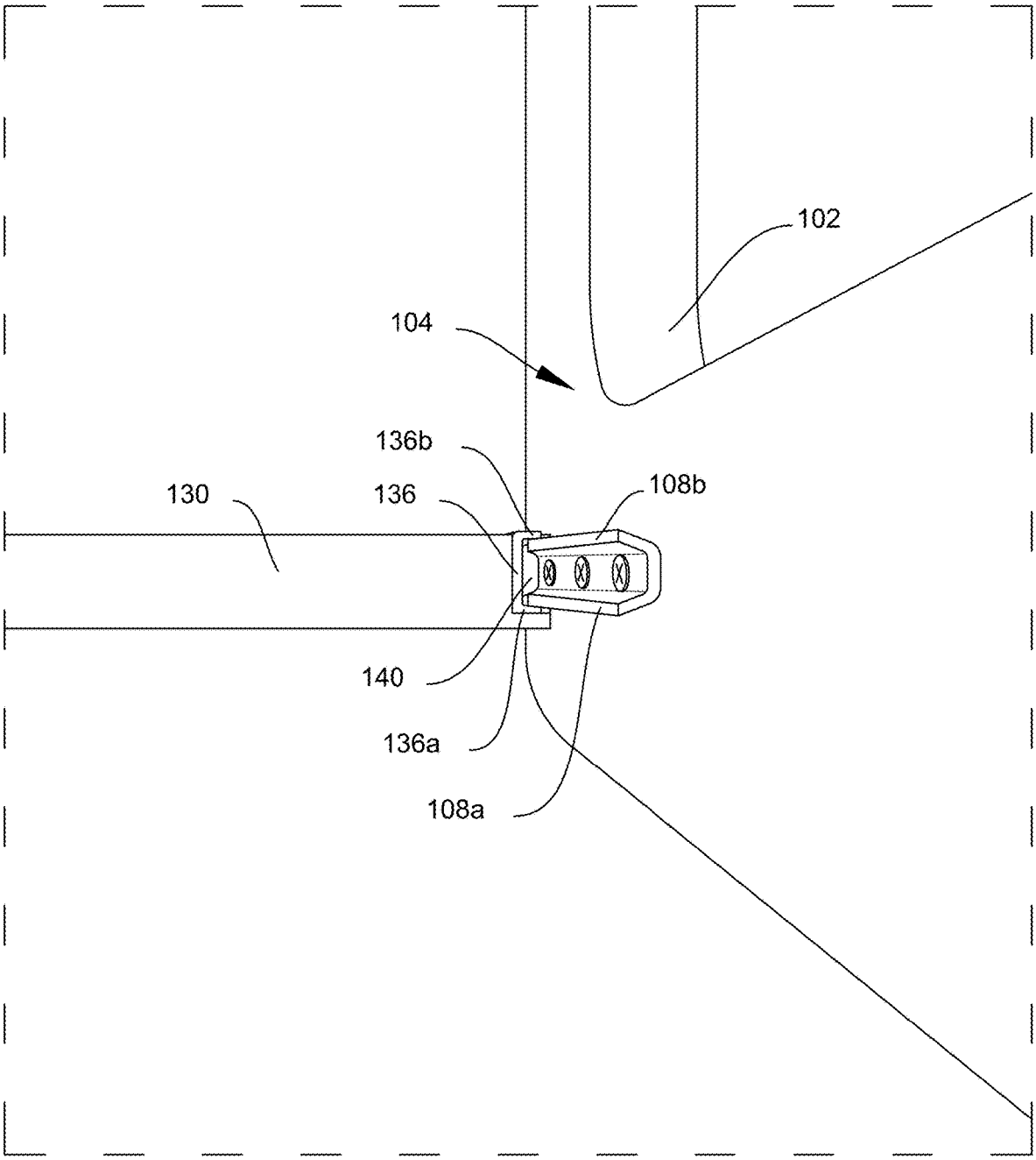
FIG. 5 illustrates a bottom perspective partial view of the childrens activity table, in accordance with embodiments of the invention.
Figure 6:
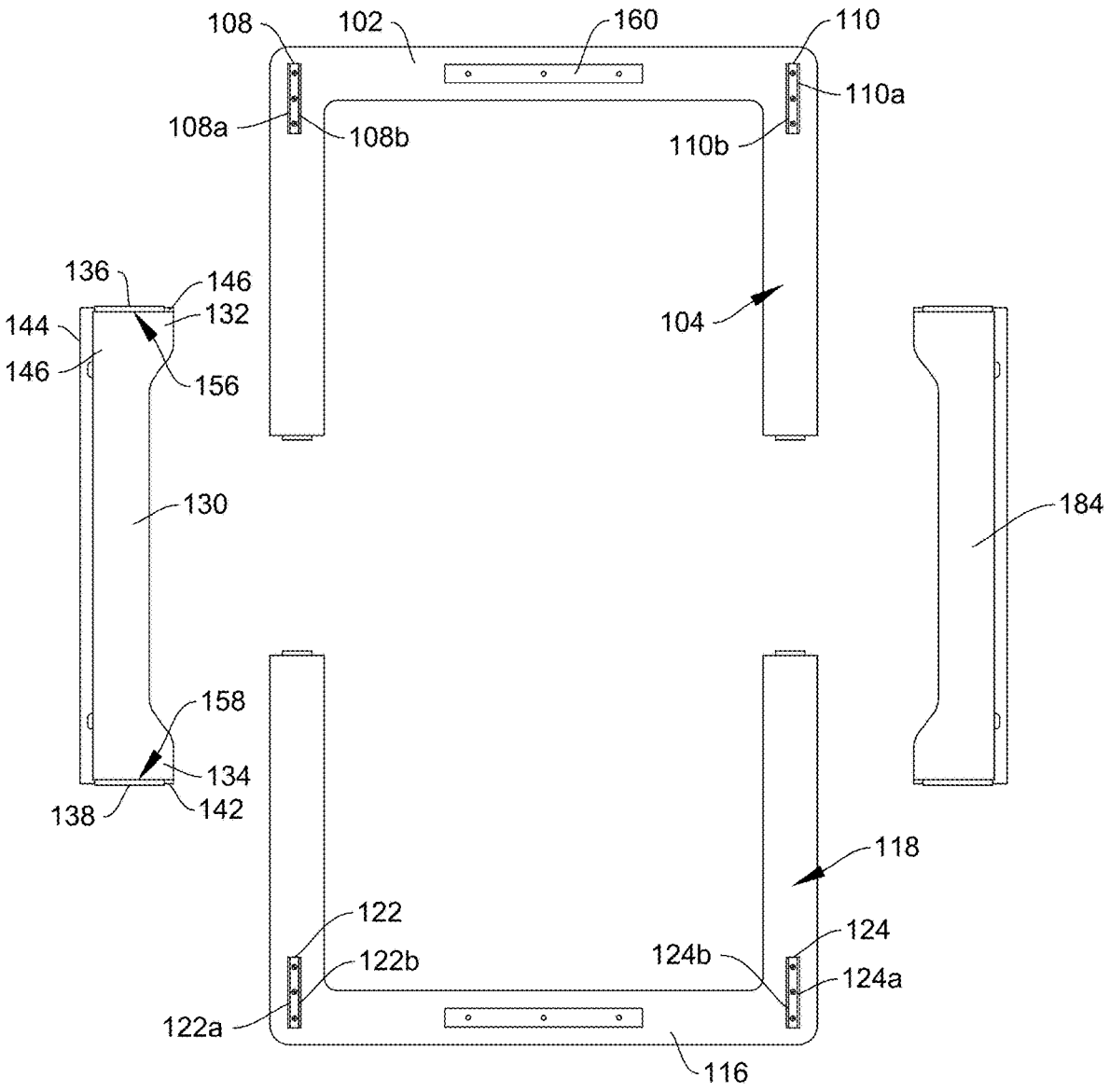
FIG. 6 illustrates an exploded elevation view of the childrens activity table, in accordance with embodiments of the invention.

Referring initially to FIGS. 1-8B, in accordance with embodiments of the invention, there is provided a children's activity table 100 having a first u-shaped leg 102 and a second u-shaped leg 116. The first u-shaped leg 102 has an inner surface 104 opposite an outer surface 106. The inner surface 104 of the first u-shaped leg 102 includes a first elongated mounting plate 108 and a second elongated mounting plate 110, as shown in FIGS. 1, 5, and 6.

Referring to FIGS. 1-3 and FIGS. 5-6, the first and second elongated mounting plates 108,110 each have a first elongated annular rail 108*a*,110*a* spaced apart in a non-parallel orientation to a second elongated annular rail 108*b*, 110*b*, respectively. The first elongated annular rail 108*a*,110*a* and the second elongated annular rail 108*b*,110*b* form respective mounting brackets 112,114 on the inner surface 104 of the first u-shaped leg 102. In other words, the first elongated annular rail 108*a* and the second elongated annular rail 108*b* form one mounting bracket 112 on the inner surface 104 of the first u-shaped leg 102, as exemplified in FIGS. 5-6. And the first elongated annular rail 110*a* and the second elongated annular rail 110*b* form another mounting bracket 114 on the inner surface 104 of the first u-shaped leg 102.

The childrens activity table preferably includes a second u-shaped leg 116. The second u-shaped leg 116 has an inner surface 118 opposite an outer surface 120. The inner surface preferably includes a third elongated mounting plate 122 and a fourth elongated mounting plate 124, as shown in FIG. 6.

Figure 2:
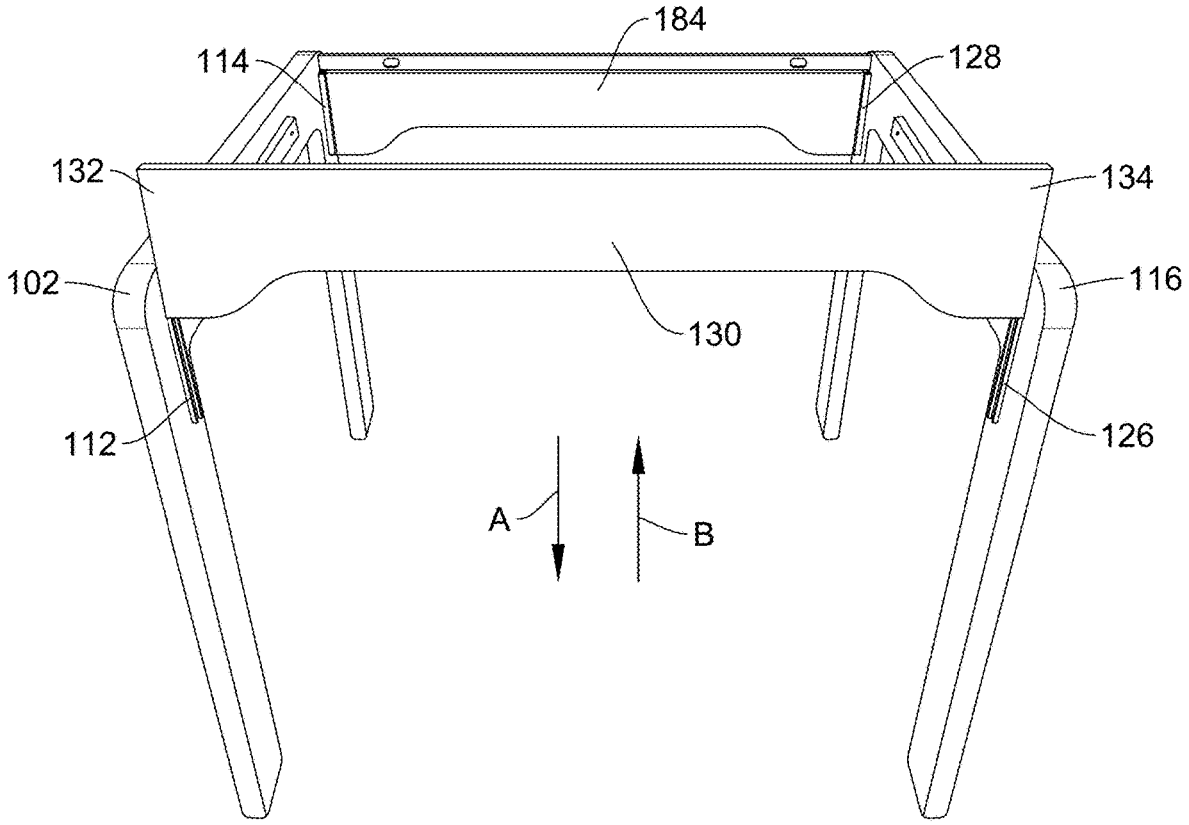
FIG. 2 illustrates another front perspective view of the childrens activity table, in accordance with embodiments of the invention.

The third and fourth elongated mounting plates 122,124 each have a first elongated annular rail 122*a*,124*a* spaced apart in a non-parallel orientation to a second elongated annular rail 122*b*, 124*b*, respectively. In a preferred embodiment, the third and fourth elongated mounting plates 122, 124 are identical in structure as the first and second mounting plates 108,110. The first elongated annular rail 122*a*, 124*a* and the second elongated annular rail 122*b*,124*b* form respective mounting brackets 126,128 on the inner surface 118 of the second u-shaped leg 116, as shown in FIG. 2 and FIG. 6.

Referring to FIGS. 2-7, the childrens activity table includes a first apron 130 having a first end 132 opposite a second end 134. The first end 132 of the first apron 130 includes a first elongated apron plate 136, and the second end 134 of the first apron 130 includes a second elongated apron plate 138.

As shown in FIG. 6, the first and second elongated apron plates 136,138 of the first apron 130 each have respective elongated annular rails (136*a*,136*b* and 138*a*, 138*b*), spaced apart in a non-parallel orientation, such that the elongated annular rails 136*a*,136*b* of the first elongated apron plate 136 form a first annular pocket 140 on the first end 132 of the first apron 130; and the elongated annular rails 138*a*,138*b* of the first elongated apron plate 136 form a second annular pocket 142 on the second end 134 of the first apron 130.

The first annular pocket 140 and second annular pocket 142 are configured to slidably and removably receive and engage, respectively, the mounting bracket 112 of the first u-shaped leg 102 and the mounting bracket 126 of the second u-shaped leg 126, as shown in FIG. 3, for the childrens activity table 100 to stand upright in a standing position, as shown in FIGS. 2-5.

Figure 7:
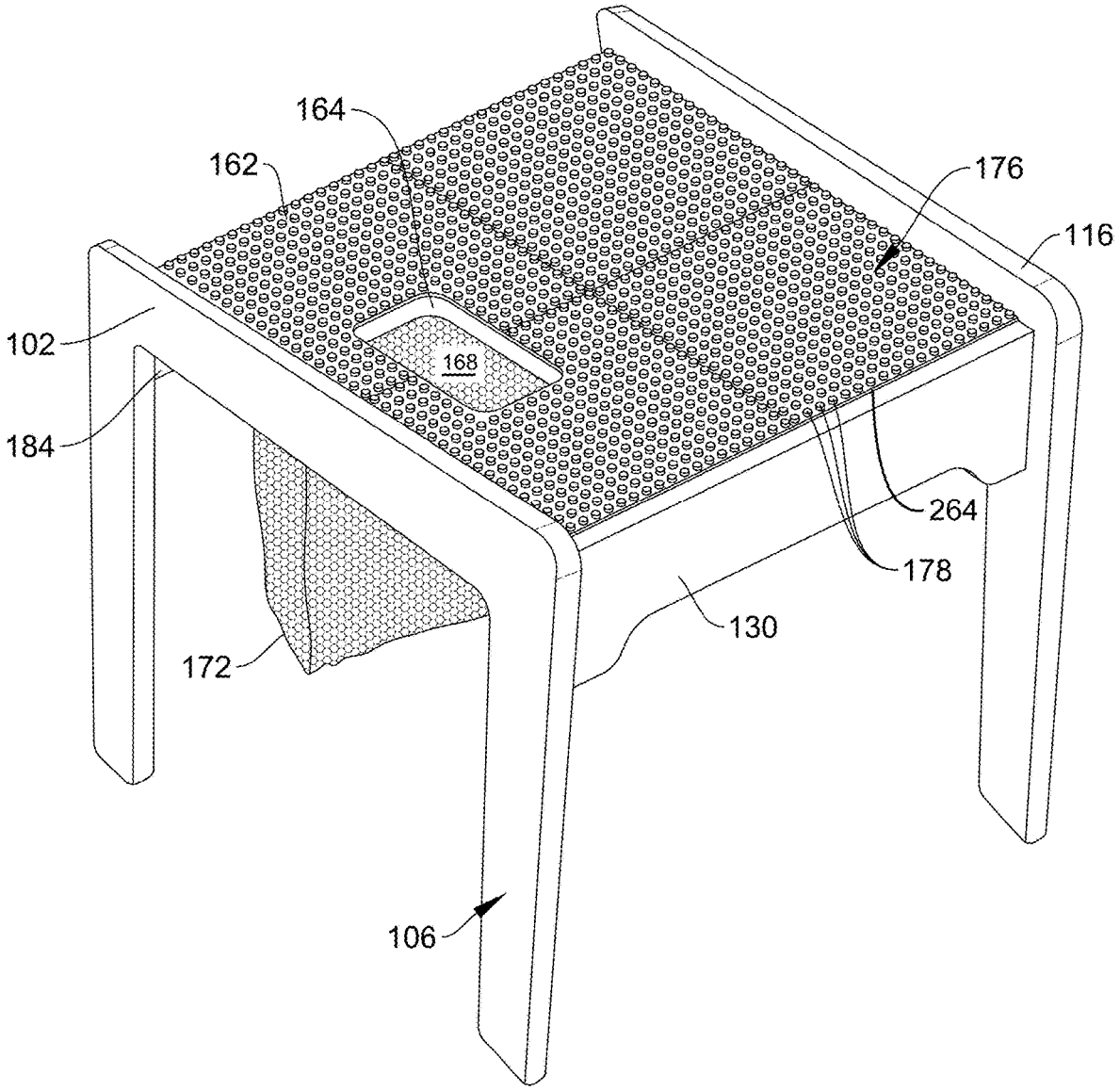
FIG. 7 illustrates a front left top perspective view of the childrens activity table, in accordance with embodiments of the invention.

In a preferred embodiment, the first apron 130 of the children's activity table 100 has an outer wall 144 opposite an inner wall 146, wherein the outer wall 144 has a height 148 that is greater than a height 150 of the inner wall 146, as illustrated in FIG. 3. As such, when the childrens activity table 100 is fully assembled, as exemplified in FIG. 7, a table top 162 may be recessed (relative to the outer wall 144) when the table top 162 is removably positioned atop the inner wall 146 of the first apron 130, as illustrated in FIG. 7. In a preferred embodiment, the same is true for a second apron 184, which preferably mirror-images the first apron 130, as further described and noted below, and as illustrated in FIGS. 6-7.

In a preferred embodiment, as shown in FIG. 3, the first apron 130 of the children's activity table 100 has an outer wall 144 opposite an inner wall 146, and the outer wall 144 has a length 152 that is greater than a length 154 of the inner wall. As such, the first elongated apron plate 136 that is disposed on the first end 130 of the first apron 130 and the second elongated apron plate 138 that is disposed on the second end 134 of the first apron 130 are both not visible to by a user when viewing an outside of the childrens activity table 100 while in the standing position, as exemplified in FIG. 4.

Referring to FIG. 6, in a preferred embodiment, the inner wall 146 of the first apron 130 has a first mounting end surface 156 opposite a second mounting end surface 158. In such embodiment, the first elongated apron plate 136 is disposed on the first mounting end surface 156, and the second elongated apron plate 138 is disposed on the second mounting end surface 158. Preferably, as shown in FIG. 6, the first elongated apron plate 136 is oriented in an opposite direction as the second elongated apron plate 138.

As exemplified in FIGS. 2-3 and 5, the first annular pocket 140 of the first elongated apron plate 108 of the first apron 130 slidably receives and engages the mounting bracket 112 (that is formed by the first elongated mounting plate 108) of the first u-shaped leg 102, and the second annular pocket 142 of the second elongated apron plate 138 slidably receives and engages the mounting bracket 114 (that is formed by the second elongated mounting plate 110) of the first u-shaped leg 102, by a movement in the direction of Arrow A in FIGS. 2-3. Such exemplary movement in the direction of Arrow A is illustrative of an assembly of the childrens activity table 100 into the standing position (FIGS. 4 and 7) without use of any tools by a user. Conversely, an exemplary movement in the direction of Arrow B in FIGS. 2-3 is illustrative of a disassembly of the childrens activity table 100 into a disassembled position (FIG. 6) without use of any tools by the user.

As shown in FIGS. 1, 4, and 6, the first u-shaped leg 102 preferably includes a horizontal support member 160 that is disposed on the inner surface 104 of the first u-shaped leg 102.

Figure 8A:
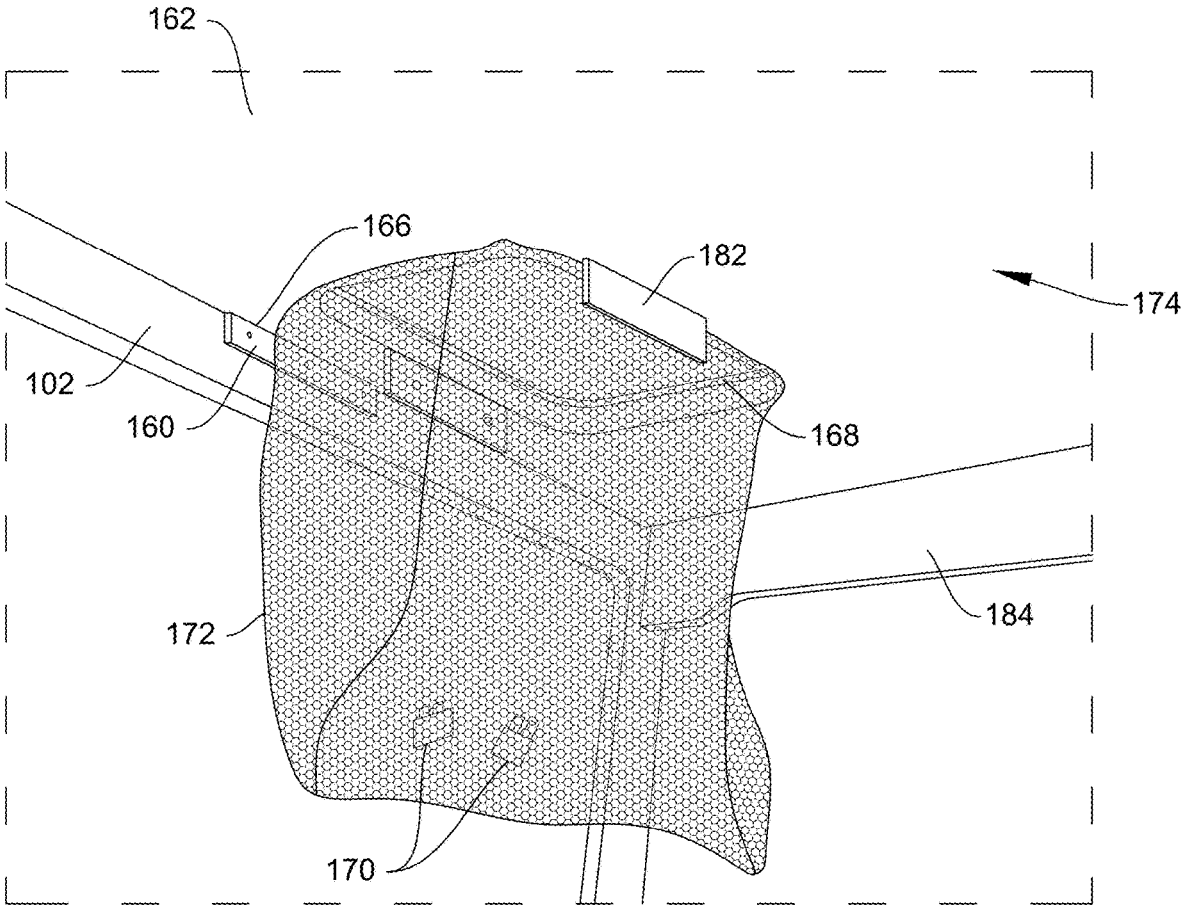
FIG. 8A illustrates a back right bottom perspective partial view of the childrens activity table, in accordance with embodiments of the invention.
Figure 8B:
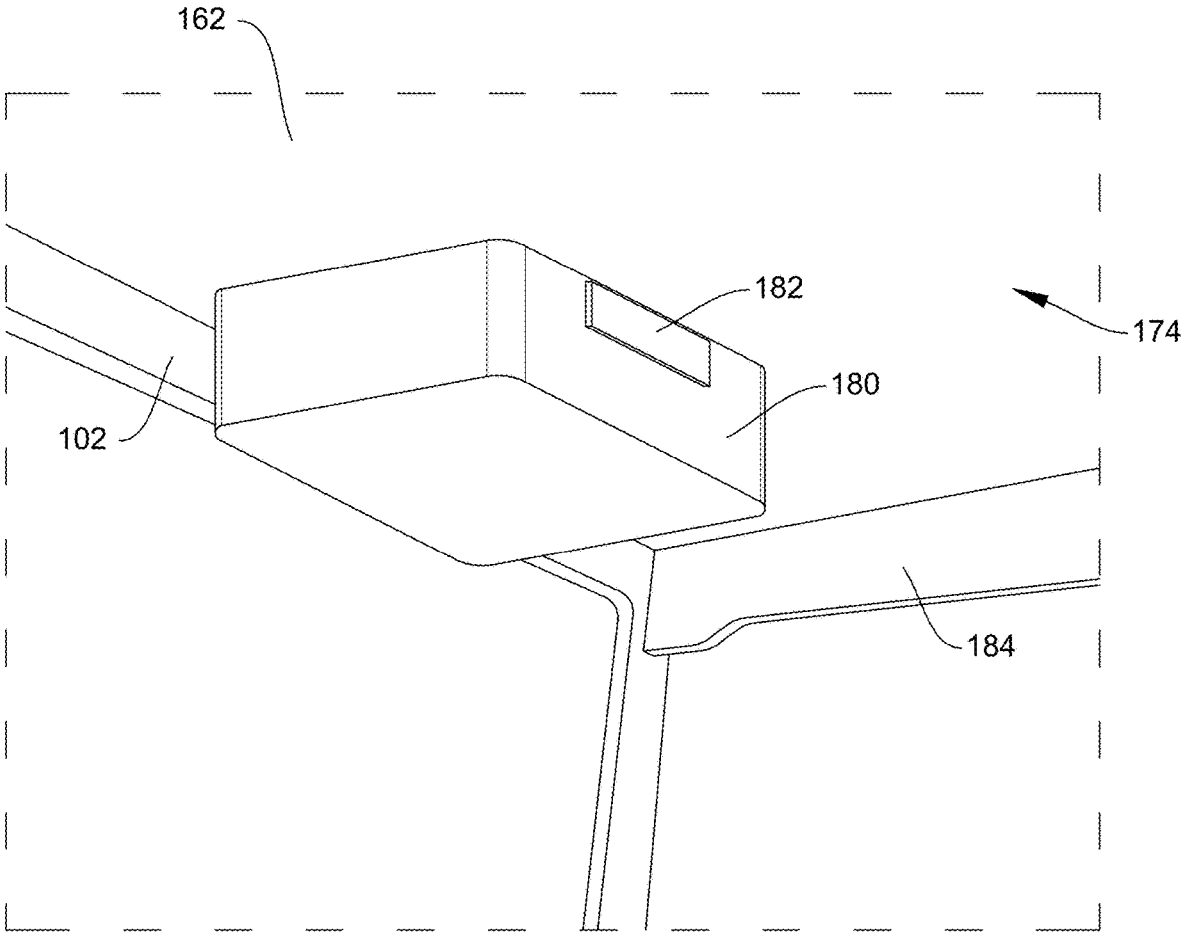
FIG. 8B illustrates another back right bottom perspective partial view of the childrens activity table, in accordance with embodiments of the invention.

Referring to FIGS. 7-8B, the children's activity table 100 includes a table top 162 preferably having a planar body 164 that is adapted to slidably and removably engage the first u-shaped leg 102, the second u-shaped leg 116, and the first apron 130 in the standing position. As seen in FIGS. 8A and 8B, a portion 166 of the planar body 164 is removably engaged atop the horizontal support member 160 of the u-shaped leg 102.

In a preferred embodiment, the u-shaped legs (102,116) and the planar body 164 of the table top 162 of the children's activity table 100 are fabricated out of wood. The wood is preferably a hard wood, yet in another embodiment, the u-shaped legs (102,116) and the planar body 164 of the table top 162 of the children's activity table 100 include non-laminated or laminated covered particle board or MDF.

In another embodiment, the planar body 164 of the table top 162 of the children's activity table 100 is fabricated out of plastic. In yet another embodiment, the planar body 164 of the table top 162 of the children's activity table 100 is fabricated out of metal.

In a preferred embodiment, the planar body 164 of the table top 162 defines an opening 168 that is adapted to receive children's play toys 170 therethrough, as shown in FIGS. 7-8B As illustrated in FIGS. 7-8A, the children's activity table 100 preferably includes a storage net 172 that is removably connected to a bottom surface 174 of the planar body 164 of the table top 162. The storage net 172 is preferably disposed beneath the opening 168 of the table top 162, such that the storage net 172 is adapted to receive and contain the children's play toys 170. The storage net 172 is preferably connected to and held in place by at least one elongated support member 182, which holds storage net 172 to the bottom surface 174 of the table top 162. In a preferred embodiment, there are multiple elongated support members 182 that affix the storage net 172 to the bottom surface 174 of the table top 162.

The children activity table preferably includes a second apron 184 that mirror images the first apron 130, as shown in FIGS. 1-2, 4, and 6-7.

As shown in FIG. 7, the table top 162 of the children's activity table 100 includes a top playing surface 176 that has a plurality of knobs 178 projecting perpendicularly upward from the top playing surface 176. The plurality of knobs 178 are adapted for mating with interconnecting play toys of the children's play toys 170. In other words, the children's activity table 100 is preferably provided with a surface 176 on the top side thereof that is adapted for playing with interlocking building blocks and other toys 170 of the type supplied by several manufacturers under the trademarks DUPLO, LEGO, MEGA BLOKS and PLAYMOBIL. The interconnecting play toys 170 are preferably made of plastic, and in other embodiments, the interconnecting play toys 170 are made out of wood. In yet other embodiments, the interconnecting play toys 170 are fabricated out of one or more composite materials, including for example, ABS Plastic (Acrylonitrile Butadiene Styrene) Polypropylene (PP) Polyethylene (PE), PVC (Polyvinyl Chloride), Polycarbonate (PC), Nylon Polyurethane (PU) Foams, or Thermoplastic Elastomers (TPE).

The top playing surface 176 is preferably formed from one or more plates (preferably having thin planar bodies) that is/are respectively fixed atop the planar body 164 of the table top 162, and the table top 162 and plates are inset in a shallow cavity formed by the first apron 130 having its outer wall 144 (opposite the inner wall 146) having a height that is greater than the height of the inner wall 146, as shown in FIGS. 3-4 and FIGS. 6-7. Such difference in height between the outer wall 144 and the inner wall 146 provides for the inset that is adapted for receipt of the table top 162, which is shown as inset at the top inner wall 146 of the first apron 130 and in line with the outer wall 144 of the first apron 130. The table top 162 is similarly disposed relative to the second apron 184 of the childrens activity table 100, as the second apron 184 mirror images the first apron 130.

Referring to FIG. 7, the plurality of knobs 178 of the top playing surface 176 are regularly spaced projections where the spacing of the projections being such that the preferred top playing surface 176 is adapted to removably receive and connect to the interlocking building blocks and other toys 170 of the types described herein.

In one embodiment, the plurality of plurality of knobs 178 are integrally formed with the top playing surface 176 of the planar body 164 of the table top 162 as a unitary construction. In another embodiment, the top playing surface 176 is preferably formed as either one plate 264 or as multiple plates that is/are fixed atop the planar body 164 of the table top 162, where the one plate 264 or the multiple plates are preferably fixed with glue or resin, as illustrated in FIG. 7. In other words, in such embodiment, the one plate 264 or the multiple plates 264 are preferably glued atop the planar body 164 of the table top 162. In such embodiment, each plate 264 has a thin planar body, which as described herein, is either smooth (as illustrated in FIGS. 24-27) or comprises the plurality of plurality of knobs 178 projecting upwardly therefrom (as illustrated in FIG. 7). The one or more plates 264 are preferably made of plastic, and in other embodiments, the one or more plates 264 are fabricated out of wood. In other embodiments, the one or more plates 264 are constructed of a composite material. In a preferred embodiment, the plurality of knobs 178 are integrally formed with the respective one or more plates 264 from which they respectively extend or project upwardly from, as a unitary construction.

Figure 23:
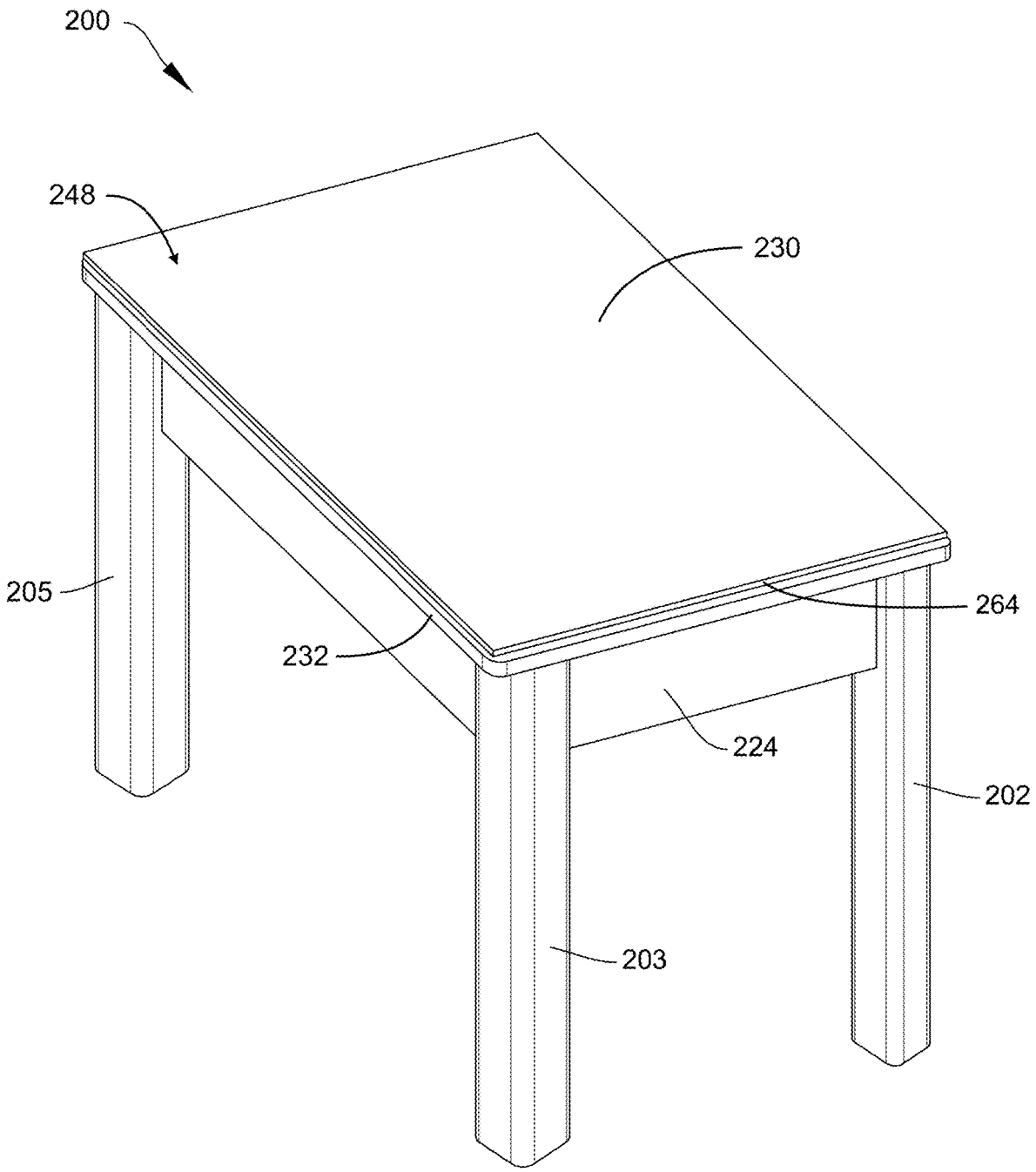
FIG. 23 illustrates a front left top perspective view of the childrens activity table, in accordance with embodiments of the invention.

Referring to FIG. 7, for example, in one embodiment, there are preferably four (4) thin plates 264 glued atop the planar body 164 of the table top 162, and, for example, all four (4) of the thin plates 264 comprise a respective plurality of plurality of knobs 178 projecting upwardly therefrom, as exemplified in FIG. 7. In another embodiment, there are two (2) thin plates 264 glued atop the planar body 164 of the table top 162, each preferably symmetric to the other. In yet another embodiment, there is one (1) thin plate 264 glued atop the planar body 164 of the table top 162, as exemplified in FIGS. 23-24.

In another embodiment, there are preferably four (4) thin plates 264 glued atop the planar body 164 of the table top 162, and, for example, two (2) of the thin plates 264 are smooth and two (2) of the thin plates comprise a respective plurality of plurality of knobs 178 projecting upwardly therefrom.

In another embodiment, the children's activity table 100 includes a storage bin 180 that is removably connected to a bottom surface 174 of the planar body 164, and as illustrated in FIG. 8B, the storage bin 180 is positioned beneath the opening 168 (FIG. 7), as the storage bin 180 is adapted to receive and contain the children's play toys 170 that pass through the opening 168 of the table top 162. In such preferred embodiment, the children's activity table 100 includes the top playing surface 176 that has the plurality of knobs 178 projecting perpendicularly from the top playing surface 176, as described above, as the plurality of knobs 178 are sized and configured for mating with interconnecting toys of the children's play toys 170, as described above.

In a preferred embodiment, the planar body 164 of the table top 162 is sized and configured to adapted slidably and removably engage with the first u-shaped leg 102, the second u-shaped leg 116, and the first apron 130 when the childrens activity table 100 is in the standing position that is shown in FIGS. 4 and 7. In such embodiment, the height of the outer wall 144 of the first apron 130 is preferably greater than the height of the inner wall 146 of the first apron 130, and the planar body 164 of the table top 162 is removably supported atop the inner wall 146, held in place by gravity, while the childrens activity table 100 is in the standing position shown in FIG. 7.

In a preferred embodiment, each u-shaped leg 102, 116 of the childrens activity table 100 is fabricated out of wood. In another embodiment, each u-shaped leg 102, 116 and the table top 162 of the children's activity table 100 are fabricated out of plastic. In yet another embodiment, each u-shaped leg 102, 116 and the table top 162 of the children's activity table 100 are fabricated out of metal.

Figure 24:
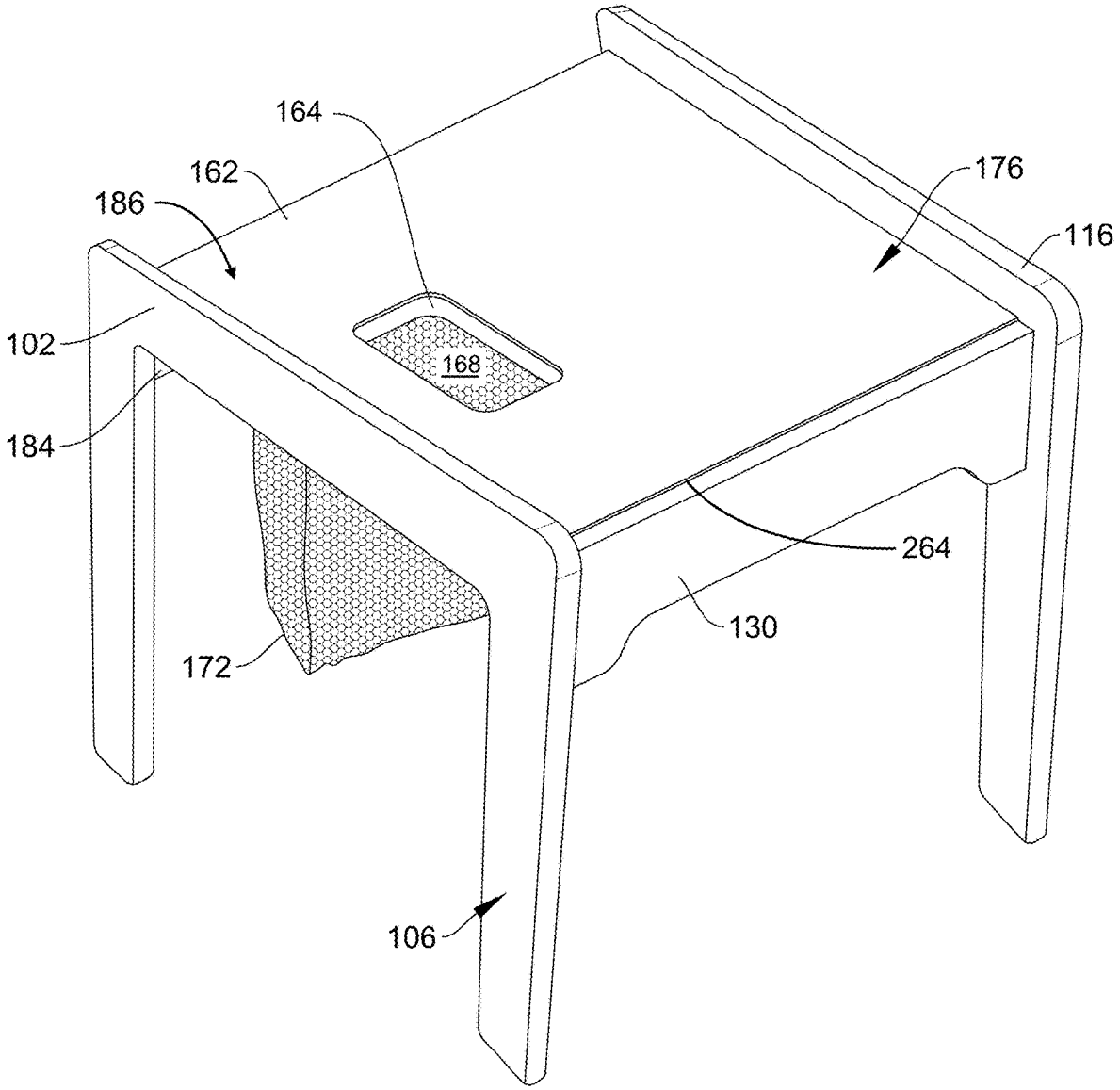
FIG. 24 illustrates a front left top perspective view of the childrens activity table of FIG. 7, in accordance with embodiments of the invention.
Figure 25:
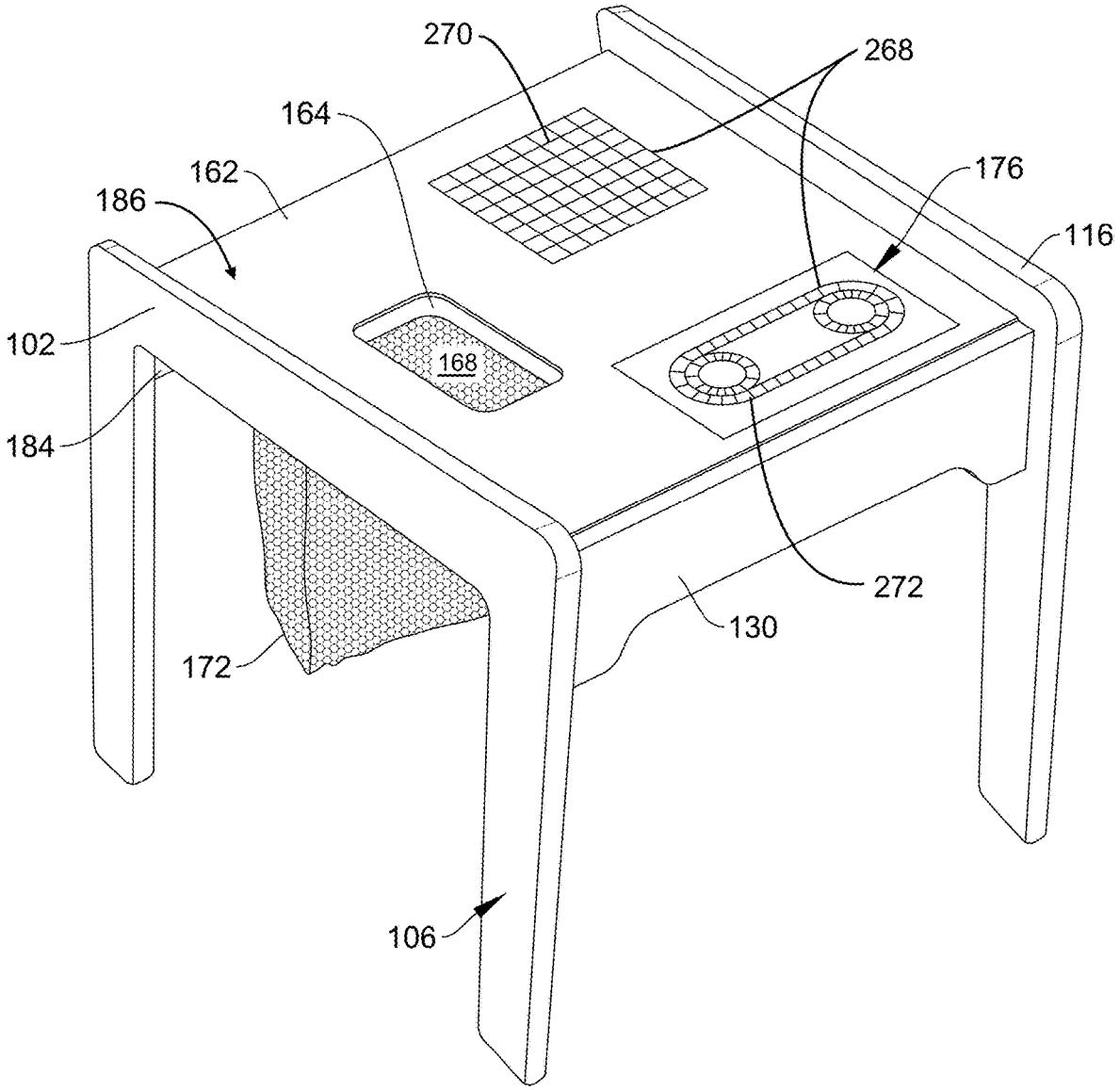
FIG. 25 illustrates a front left top perspective view of the childrens activity table, in accordance with embodiments of the invention.
Figure 26:
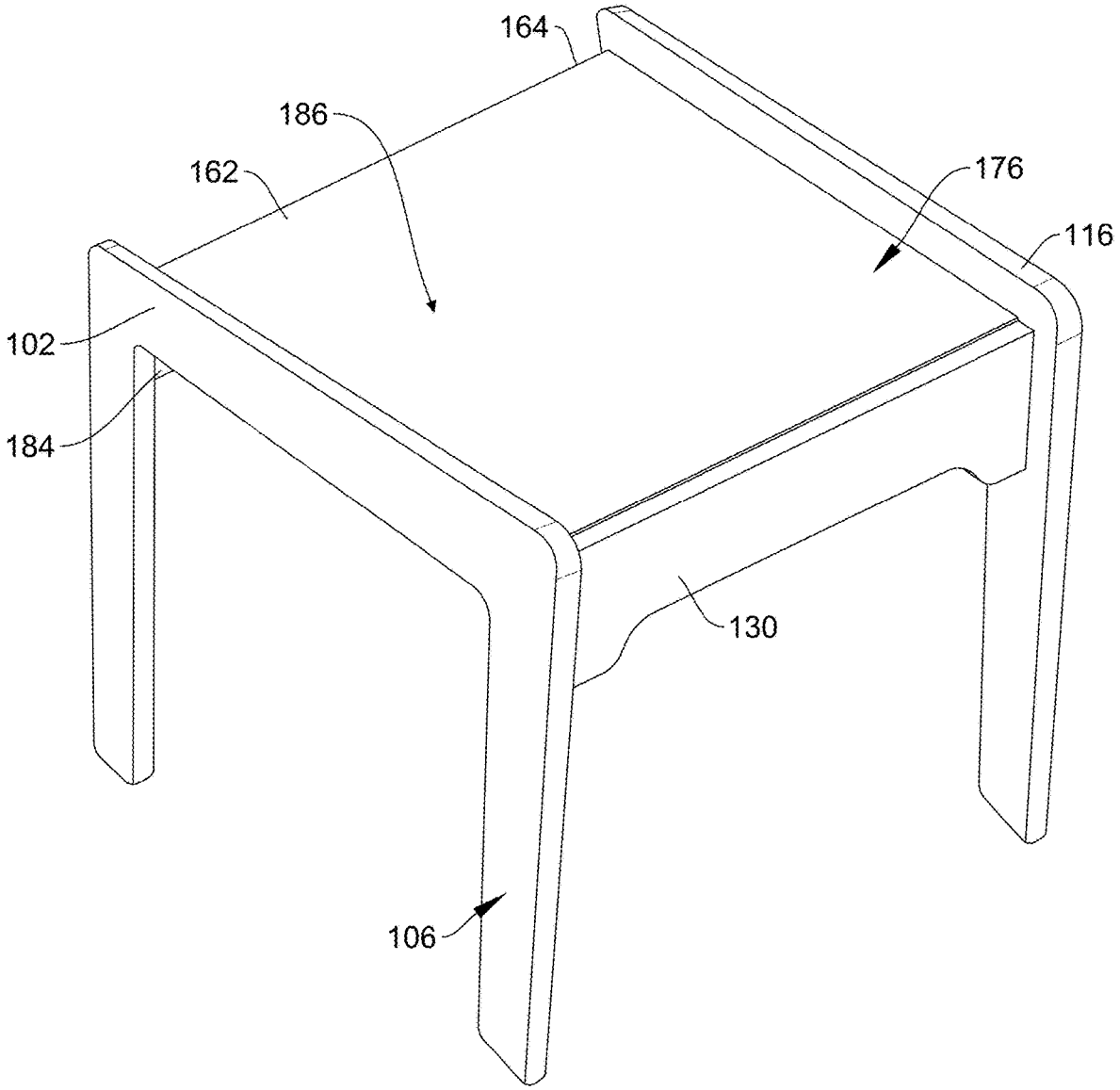
FIG. 26 illustrates a front left top perspective view of the childrens activity table, in accordance with embodiments of the invention.

In one embodiment, the table top 162 includes a smooth top laying surface 186, as illustrated in FIGS. 24-26. In a preferred embodiment, the smooth top playing surface 248 comprises markings 268, preferably including a checkers board design 270 that is integrally formed within the smooth top playing surface 186, as exemplified in FIG. 25. In one embodiment, the checkers board design 270 is fabricated is laminated atop the smooth top playing surface 186, such as, in one embodiment, for example, the checkers board design 270 is a laminated sticker that is applied atop the smooth top playing surface 186. In a preferred embodiment, the smooth top playing surface 248 features markings 268 comprising a train track design 272, as exemplified in FIG. 25.

Figure 11:
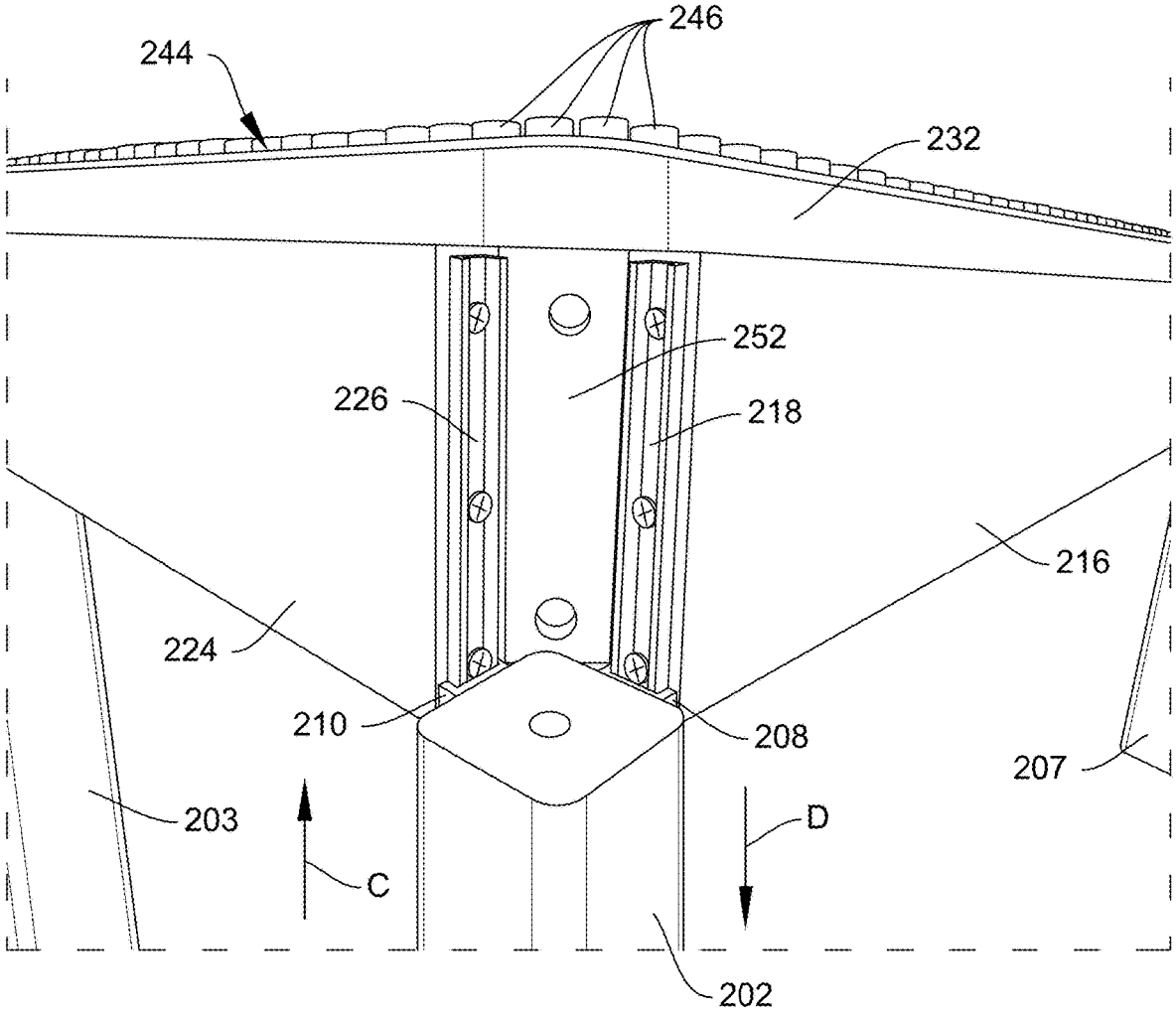
FIG. 11 illustrates another front right perspective partial view of the childrens activity table, in accordance with embodiments of the invention.
Figure 12:
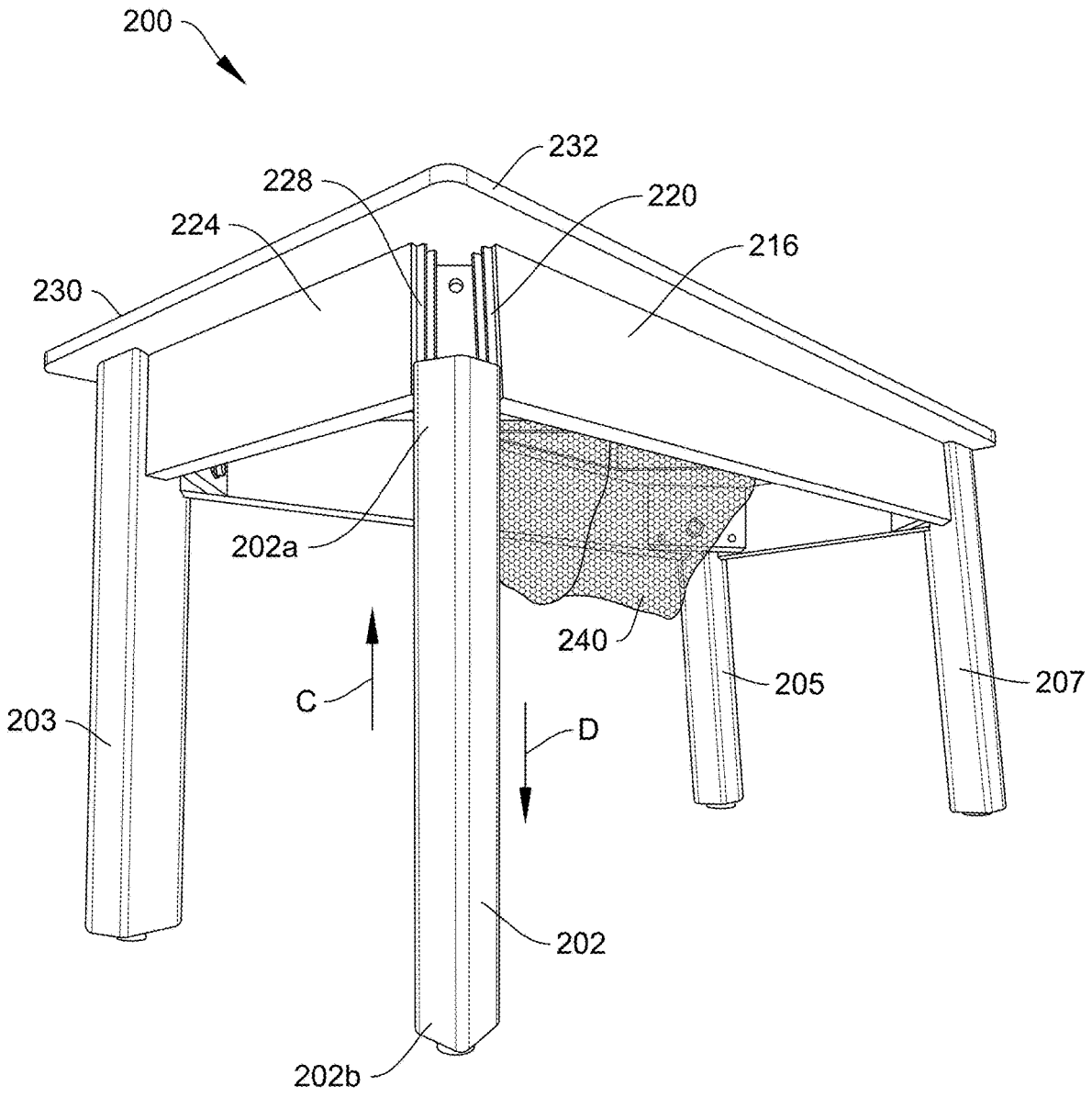
FIG. 12 illustrates a front right bottom perspective view of the childrens activity table, in accordance with embodiments of the invention.
Figure 13:
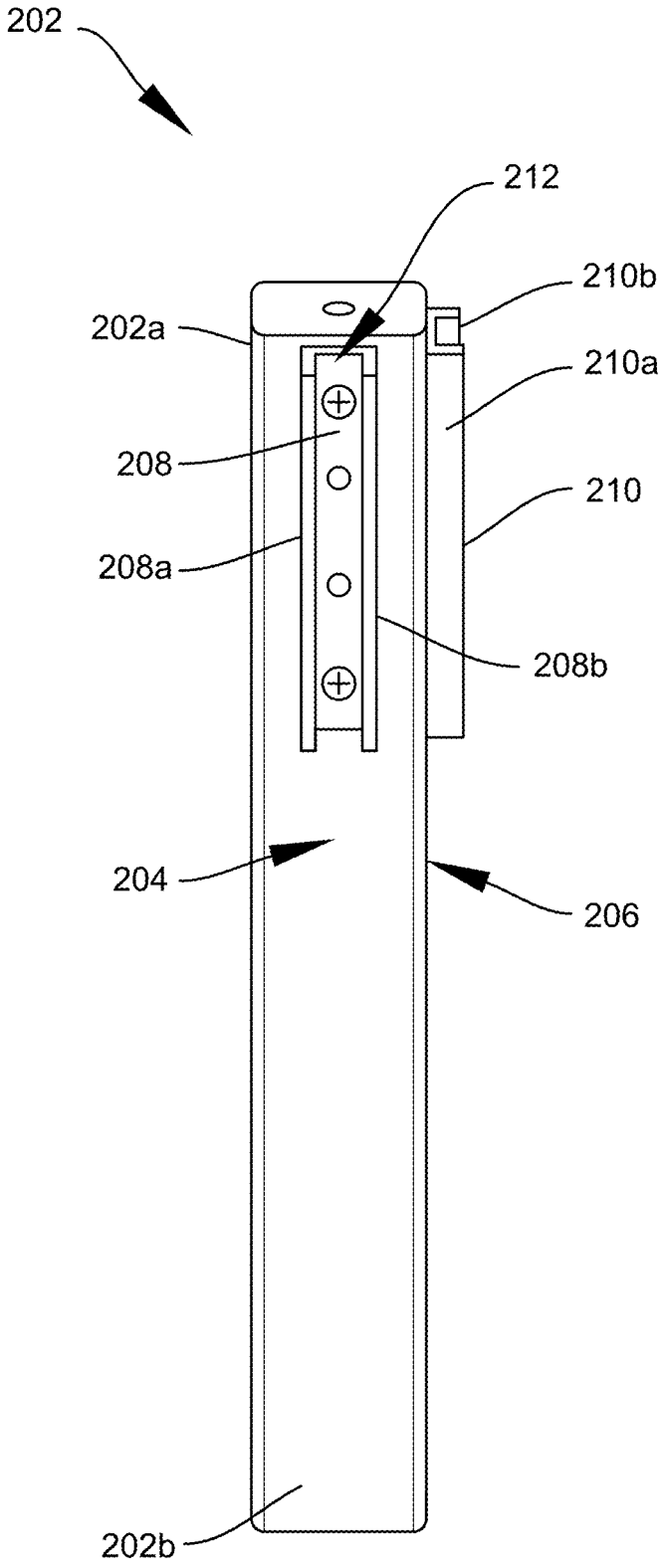
FIG. 13 illustrates a front perspective view of a first leg of the childrens activity table, in accordance with embodiments of the invention.
Figure 14:
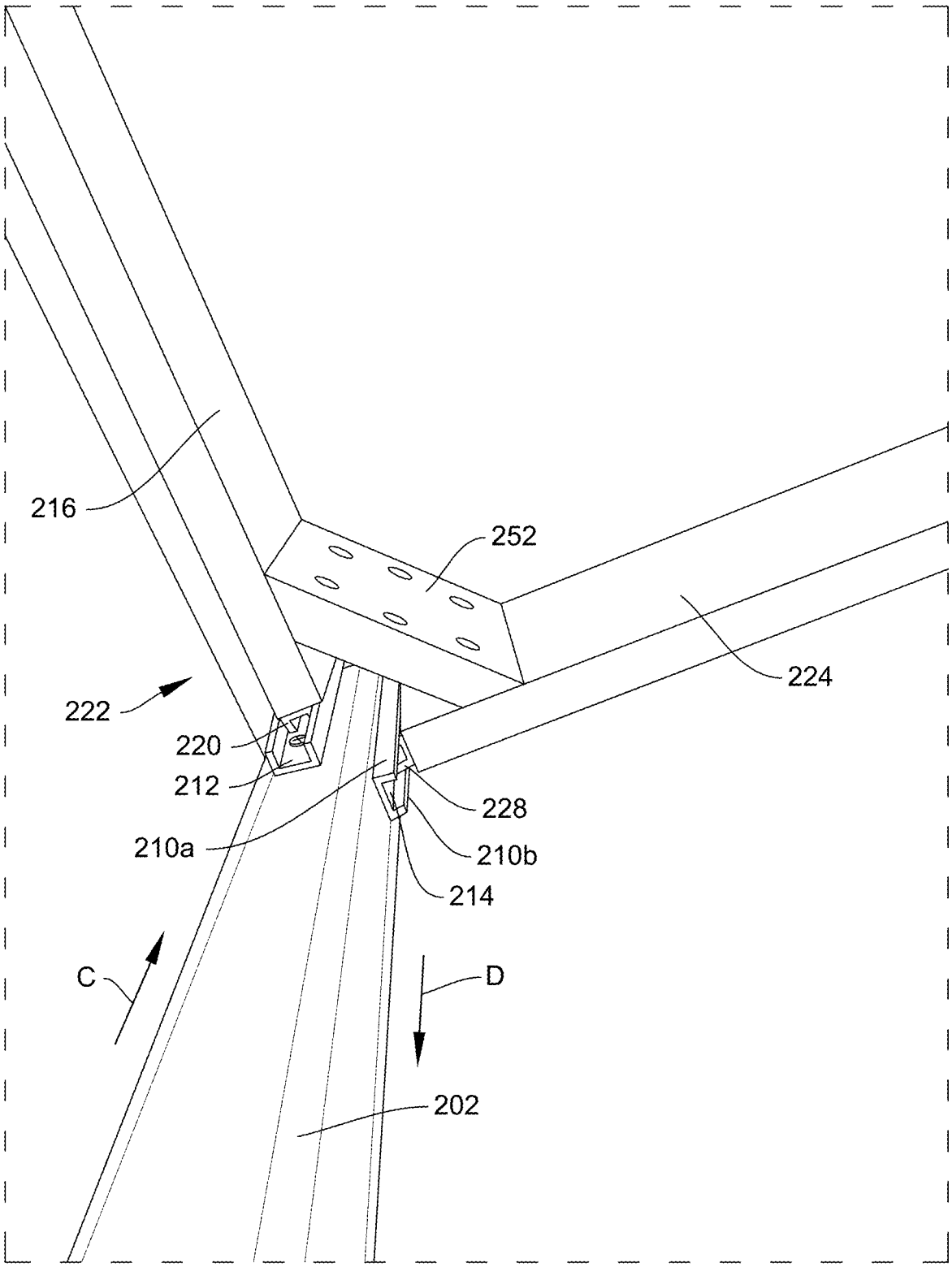
FIG. 14 illustrates a left back bottom perspective partial view of the childrens activity table, in accordance with embodiments of the invention.
Figure 15:
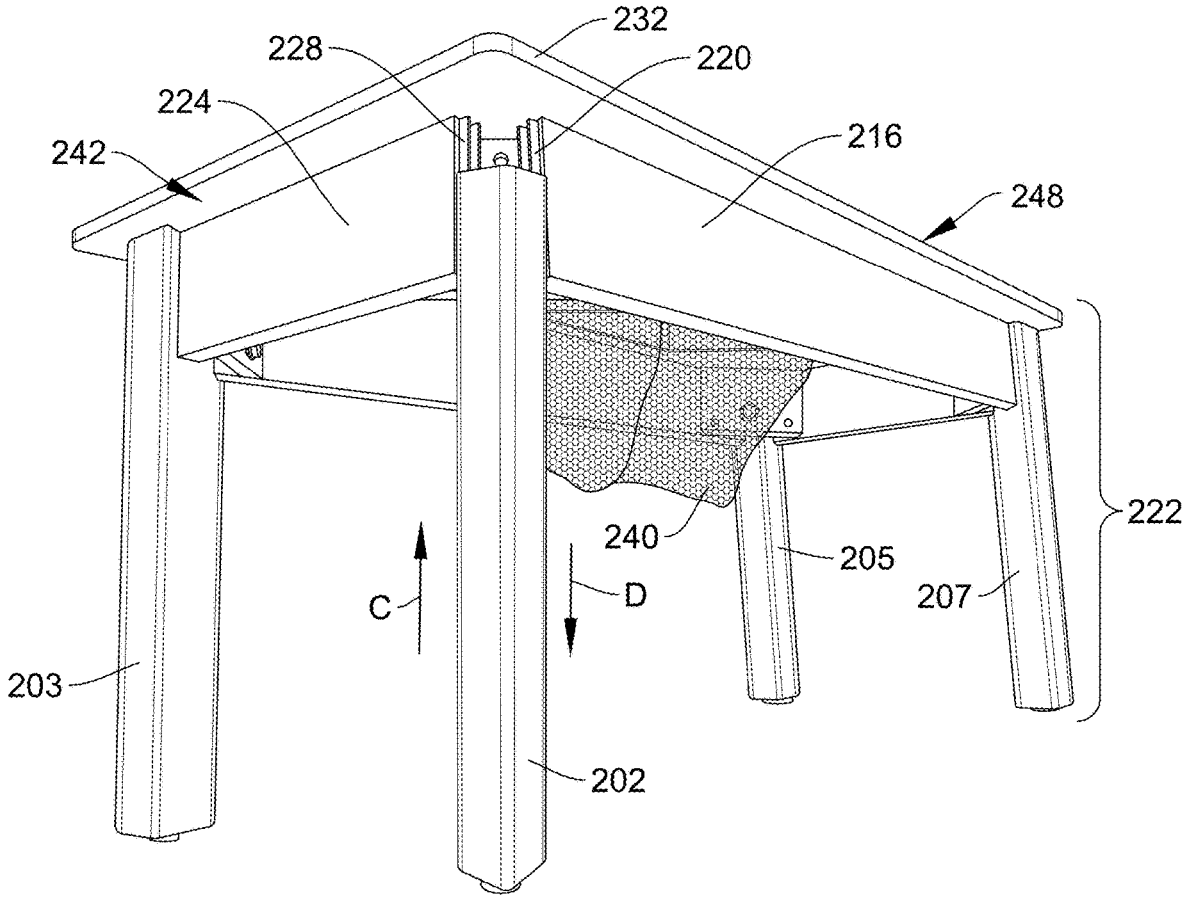
FIG. 15 illustrates a front right bottom perspective view of the childrens activity table, in accordance with embodiments of the invention.
Figure 16:
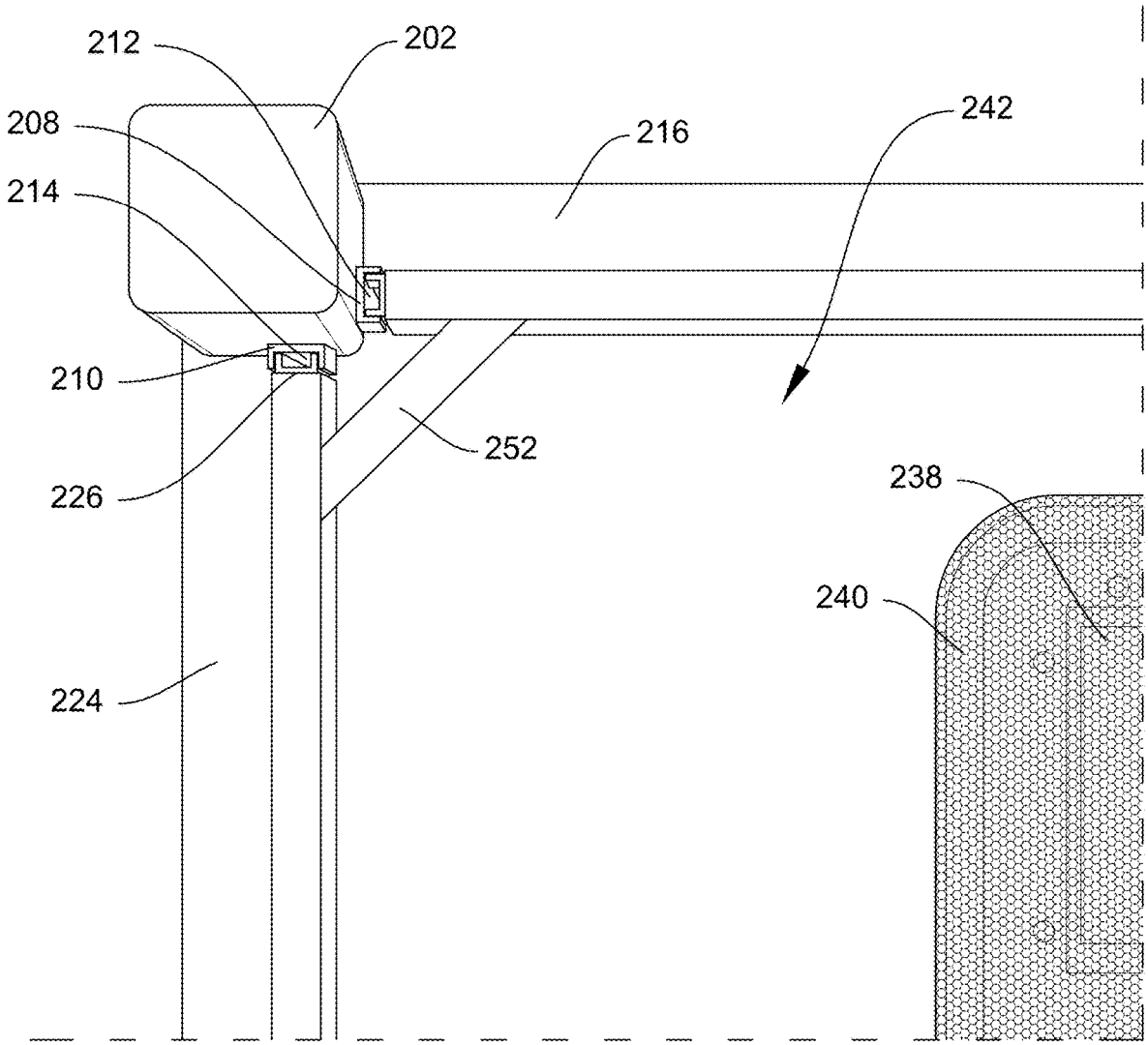
FIG. 16 illustrates a bottom perspective partial view of the childrens activity table, in accordance with embodiments of the invention.

Referring to FIGS. 9-16 and FIG. 20, there is further provided a childrens activity table 200 comprising at least a first leg 202 having a first side surface 204 that is preferably perpendicular to a second side surface 206. In a preferred embodiment, the first side surface 204 includes a first elongated mounting plate 208, and the second side surface 206 includes a second elongated mounting plate 210, as shown in FIGS. 13-14 and 16.

The first elongated mounting plate 208 and the second elongated mounting plate 210 each have a respective first elongated annular rail 208*a*,210*a* spaced apart in a non-parallel orientation to a second elongated annular rail 208*b*, 210*b*. As shown in FIG. 13, the first elongated annular rail 208*a*,210*a* and the second elongated annular rail 208*b*,210*b* respectively form a first annular pocket 212 and a second annular pocket 214, respectively, as shown in FIGS. 14 and 16.

The childrens activity table 200 includes at least a first apron 216 having at least a first elongated apron plate 218, as illustrated in FIGS. 9-12 and FIGS. 14-16. The at least first elongated apron plate 216 includes a pair of elongated annular rails 218*a*,218*b* spaced apart in a non-parallel orientation, which form a first annular apron mounting bracket 220. The first annular apron mounting bracket 220 (which is formed by the at least a first elongated apron plate 218) is sized and configured to slidably engage into the first annular pocket 212, for an upstanding table position 222, as shown in FIG. 14.

The childrens activity table 200 preferably includes at least a second apron 224 having at least a second elongated apron plate 226. The at least second elongated apron plate 226 (FIG. 10) includes a pair of elongated annular rails 226*a*,226*b* that are spaced apart in a non-parallel orientation, which form a second annular apron mounting bracket 228, as seen in FIG. 12. The second annular apron mounting bracket 228 is sized and configured to slidably engage into the second annular pocket 214, for the upstanding table position.

As shown in FIG. 13, the at least first leg 202 has a top section 202*a* opposite a bottom section 202*b*. As illustrated in FIGS. 9-16 and 20, in a preferred embodiment, the childrens activity table 200 includes a second leg 203, a third leg 205, and a fourth leg 207. As can appreciated from the Figures and the description herein, in one embodiment, the second leg 203, the third leg 205, and the fourth leg 207 are each identical in structure and components as the first leg 202, which is illustrated in FIG. 13, and each of the legs 202, 203, 205, 207 corresponds with the aprons and respective components illustrated in FIGS. 9-12, FIGS. 14-16, and FIG. 20 and described herein.

As exemplified in FIGS. 11-12 and 14-15, the at least first leg 202 slidably engages the at least a first elongated apron plate 218 and the at least a second elongated apron plate 226 of the at least first apron 216 and the at least second apron 224 by a movement of the at least first leg 202 (relative to the at least first apron 216 and the at least second apron 224) in the direction of Arrow C, as illustrated in FIGS. 11-12 and 14-15. Such upward movement in the direction of Arrow C exemplifies an assembly of the childrens activity table 100, into the standing position. In other words, such exemplary movement in the direction of Arrow C is illustrative of an assembly of the childrens activity table 100 into the standing position without use of any tools or any loose hardware by a user. Conversely, a downward movement (in the direction of Arrow D) of the at least first leg 202 relative to the at least a first apron 216 and relative to the at least a second apron 224, in the direction of Arrow D, is adapted to disassemble the childrens activity table 100. Meaning, the exemplary movement in the direction of Arrow D in FIGS. 11-12 and 14-15 is illustrative of the disassembly of the childrens activity table 100 into a disassembled position (FIG. 10) without use of any tools by the user and without the loosening or removal of any hardware by the user.

As shown in FIGS. 9-12 and FIGS. 14-16, the childrens activity table 100 includes a table top 230 preferably having a planar body 232. In one embodiment, the table top 230 is removably disposed atop the at least first apron 216 and the at least second apron 224, in the upstanding table position, as exemplified in FIG. 20. In a preferred embodiment the table top 230 is fixed atop the at least first apron 216 and the at least second apron 224. While the table top 230 is illustrated and show to have a rectangular form in FIGS. 9-12, 15-17, and 20, in other embodiments of the invention, the table top 230 is square in shape, and in other embodiments, the table top 230 is round in shape; and in other embodiments, the table top 230 is oval in shape. In other embodiments, the table top 230 has a triangular shape. In other words, embodiments of the invention include a variety of shapes of table tops 230.

In a preferred embodiment, the planar body 232 of the children's activity table 100 is fixed to a top 234 of the at least first apron and is fixed to a top 236 of the at least second apron 224.

As illustrated in FIGS. 9, 12, 15-16, and 20, the planar body 232 of the table top 230 of the children's activity table 200 defines an opening 238 adapted to receive children's play toys 170 therethrough. In a preferred embodiment, the planar body 232 of the table top 230 of the children's activity table 200 is fabricated out of wood. In a preferred embodiment, the legs (203, 203, 205, 207) and the planar body 232 of the table top 230 of the children's activity table 200 are fabricated out of wood. The wood is preferably a hard wood, yet in another embodiment, legs (203, 203, 205, 207) and the planar body 232 of the table top 230 of the children's activity table 200 include non-laminated or laminated covered particle board or medium-density fiberboard, an engineered wood product made from wood fibers, wax, and resin (MDF).

In another embodiment, the legs (203, 203, 205, 207) and the planar body 232 of the table top 230 of the children's activity table 200 are fabricated out of plastic. In yet another embodiment, the legs (203, 203, 205, 207) and the planar body 232 of the table top 230 of the children's activity table 200 are fabricated out of metal.

In a preferred embodiment, the children's activity table 200 includes a storage net 240 that is removably connected to a bottom surface 242 of the table top 230. The storage net 240 is preferably disposed beneath the opening 238 of the table top 230, as the storage net 240 is adapted to receive and contain children's play toys 170 that pass through the opening 238 of the table top 230 and into the storage net 240.

Figure 20:
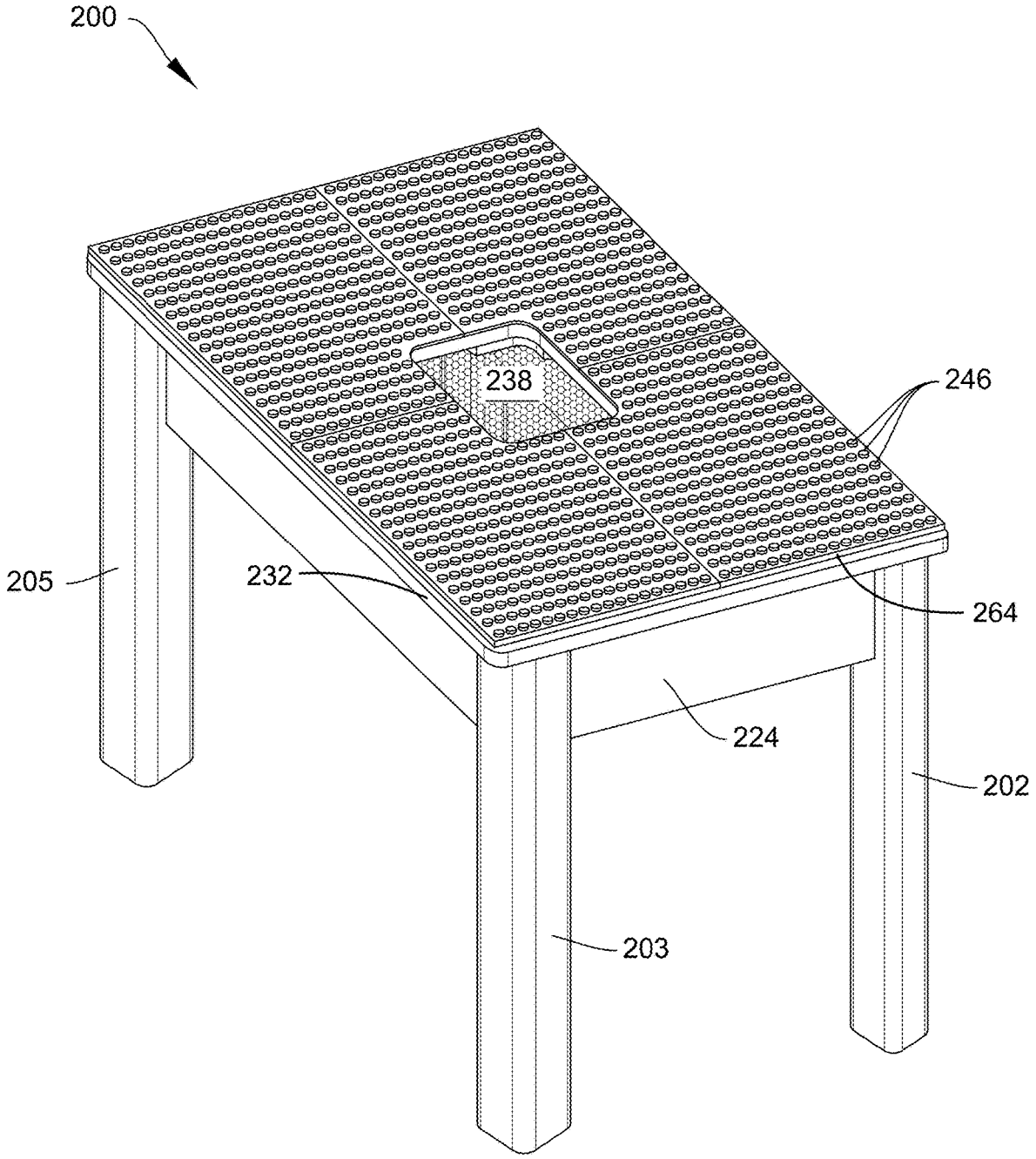
FIG. 20 illustrates a front left top perspective view of the childrens activity table, in accordance with embodiments of the invention.

As can be appreciate from this above description and respective Figures herein, the storage net 240 shown in FIG. 12 is similar to, and preferably the same as, the storage net 172 that is illustrated in FIG. 7, as connected to a bottom surface of the table top. Referring to FIG. 20, the opening 238 of the table top 230 is similar to the opening 168 shown in FIG. 7.

As shown, the opening 238 shown in FIG. 20 is positioned at a center of the table top 230, and in FIG. 7, the opening 168 is shown as off-set from a center of the table top 162. It can be appreciated from this disclosure, description and Figures herein that, in one embodiment, the opening 238 of the childrens activity table 200 is offset from the center of the table top 230, in the same manner that the opening 168 is illustrated to be offset from the center of the table top in FIG. 7. Similarly, it can be appreciated from this disclosure, Figures, and description herein that, in one embodiment, the opening 168 (FIG. 7) of the childrens activity table 100 is positioned at the center of the table top 162, in the same manner that the opening 238 is illustrated to be at the center of the table top 230 in FIG. 20. In addition, it can be appreciated from this disclosure, Figures, and description herein that, in one embodiment, there are two openings 168 defined by the table top 162. In addition, it can be appreciated from this disclosure, Figures, and description herein that, in one embodiment, there are two openings 168, 238 defined by the table top 162. In another embodiment, there are two openings 168, 238 defined by the table top 230.

In another embodiment, the children activity table includes a storage bin 180 (FIG. 8B) that is preferably removably connected to a bottom surface 242 of the table top 230. In such embodiment, the storage bin 180 is disposed beneath the opening 238, as the storage bin 180 is adapted to receive and contain children's play toys 170 that pass through the opening 238 and into the storage bin 180.

The storage bin 180 is attached to the bottom surface 242 of the table top 230 in the same manner as is illustrated in FIG. 8B.

In a preferred embodiment, the table top 230 of the children's activity table 200 includes a top playing surface 244 having a plurality of knobs 246 projecting perpendicularly from the top playing surface 244. The plurality of knobs 246 are adapted for mating with interconnecting toys, in the same manner as described in detail above. In another preferred embodiment, the planar body 232 of the table top 230 of the childrens activity table 200 defines at least two openings 168, 238 adapted to receive children's play toys therethrough, as described above.

Figure 9:
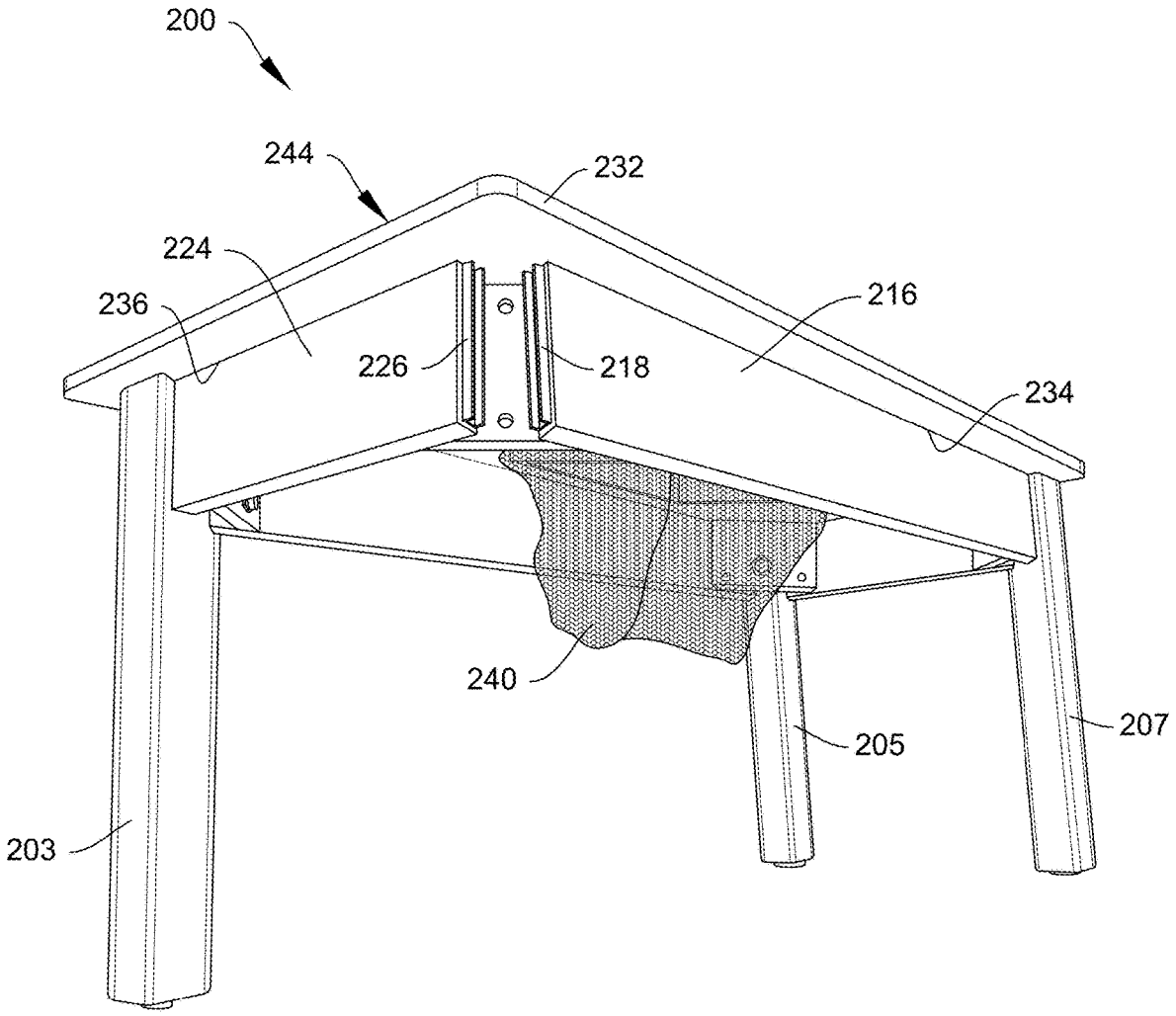
FIG. 9 illustrates a front right bottom perspective view of a childrens activity table, in accordance with embodiments of the invention.
Figure 10:
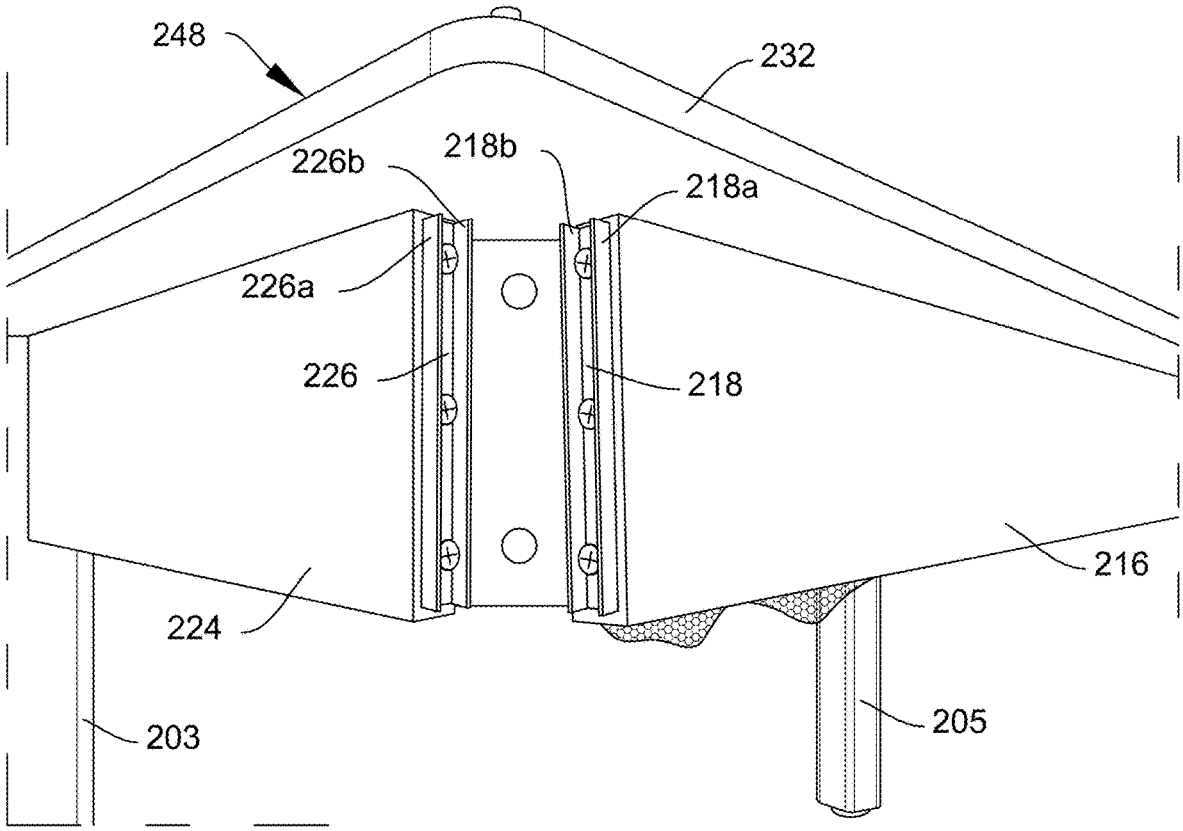
FIG. 10 illustrates a front right perspective partial view of the childrens activity table of FIG. 9, in accordance with embodiments of the invention.
Figure 17:
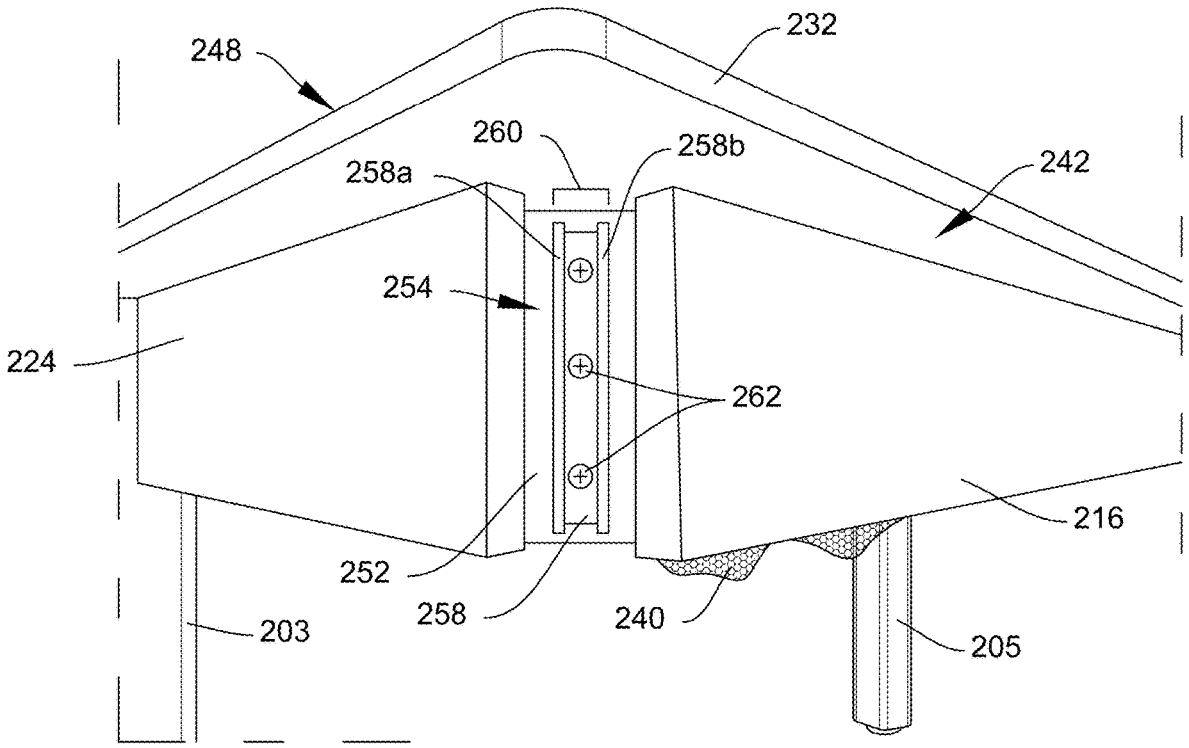
FIG. 17 illustrates a front right perspective partial view of a childrens activity table, in accordance with embodiments of the invention.

In another embodiment, the table top 230 of the children's activity table 200 has a smooth top playing surface 248, as illustrated in FIGS. 9, 10, and 12. In other words, the smooth top playing surface 248, which for example is exemplified in FIG. 17, is where the top playing surface 244 does not contain the plurality of knobs 246 projecting perpendicularly from the top playing surface 244.

Figure 21:
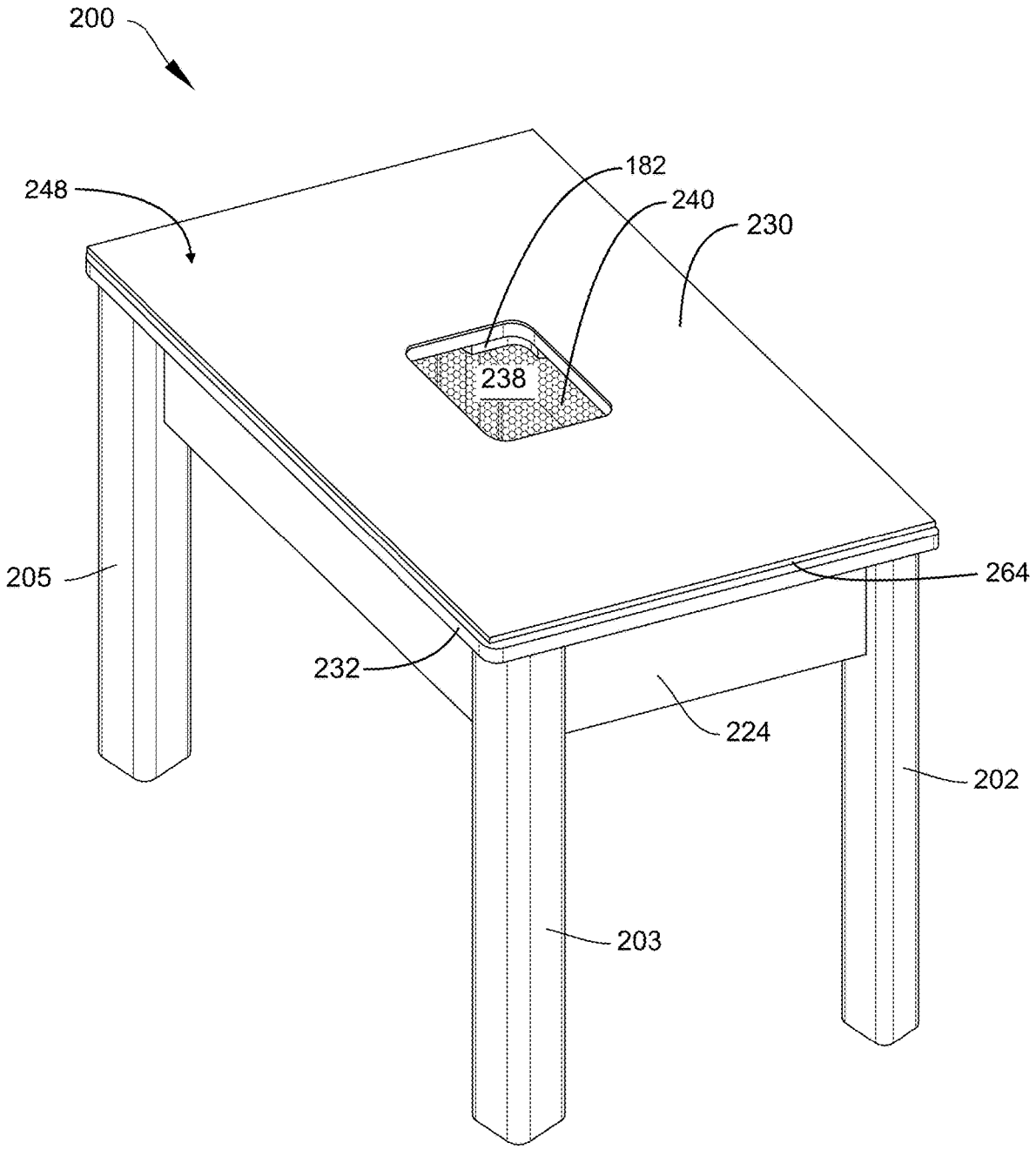
FIG. 21 illustrates a front left top perspective view of the childrens activity table, in accordance with embodiments of the invention.

In one embodiment, the plurality of plurality of knobs 246 are integrally formed with the top playing surface 244 of the planar body 232 of the table top 230 as a unitary construction. In another embodiment, the top playing surface 244 is preferably formed as either one plate 264 (FIGS. 21-23) or as multiple plates 264 (FIG. 20) that is/are fixed atop the planar body 232 of the table top 230, where the one plate 264 or the multiple plates 264 are preferably fixed with glue or resin. In other words, in such embodiment, the one plate 264 or the multiple plates 264 is/are preferably glued atop the planar body 232 of the table top 230, as exemplified in FIG. 20, which illustrates four (4) respective plates 264 fixed atop the table top 230. In such embodiment, each plate 264 preferably has a thin planar body (preferably thinner than the planar body 232 of the table top 230), which as described herein, is either smooth 248 or respectively comprises the plurality of plurality of knobs 246 projecting upwardly therefrom. An example of a thin plate 264 having a smooth top playing surface 248 is illustrated at 244 and 248 in FIGS. 9-10 and FIGS. 21-23. An example of a thin plate 264 having the plurality of plurality of knobs 246 projecting upwardly therefrom is illustrated at 244 and 246 in FIGS. 11 and 20.

Figure 22:
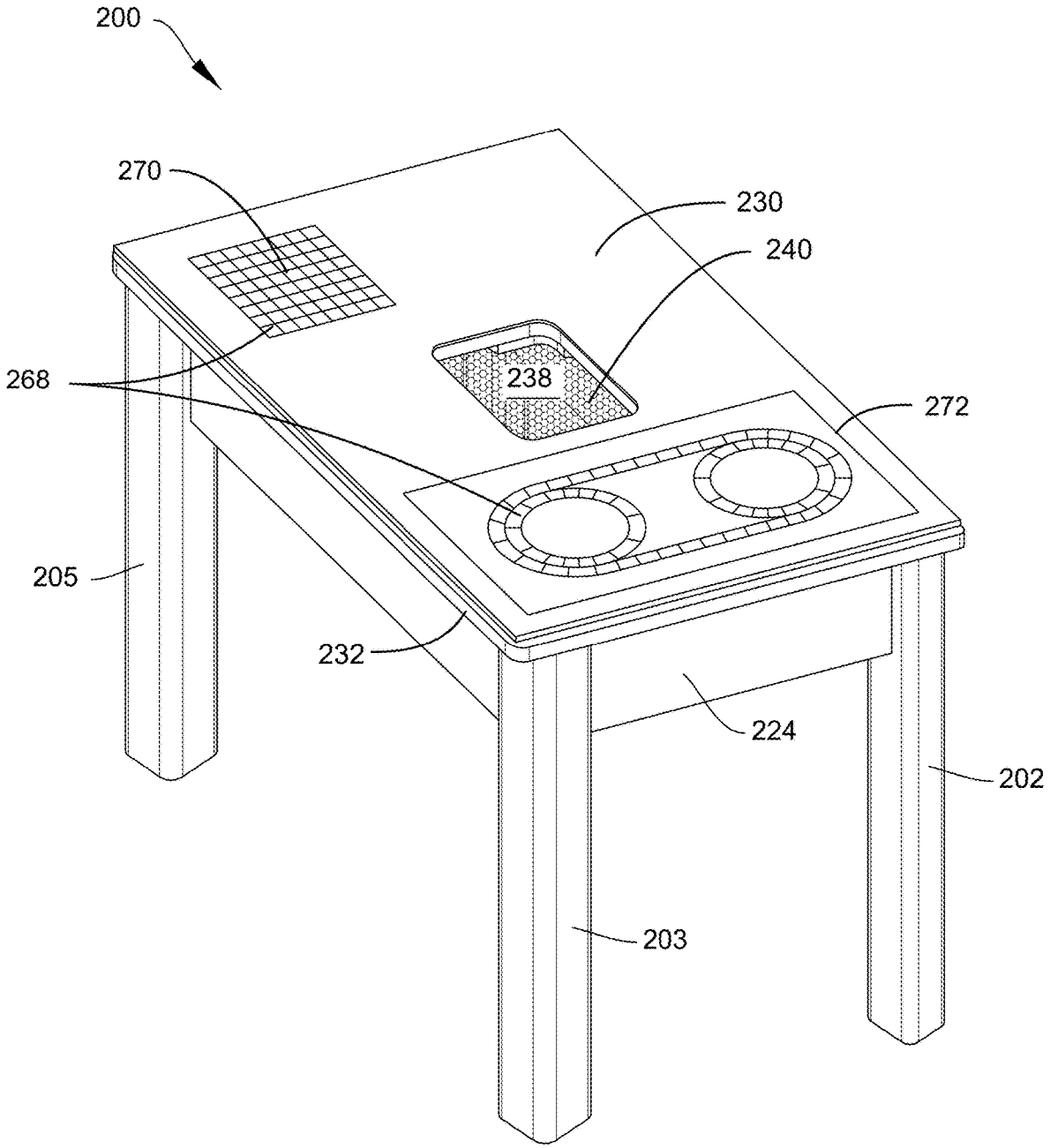
FIG. 22 illustrates a front left top perspective view of the childrens activity table, in accordance with embodiments of the invention.

Referring to FIG. 22, in a preferred embodiment, the smooth top playing surface 248 comprises markings 268 that feature designs for table top games. For instance, the smooth top playing surface 248 preferably features markings 268, which in a preferred embodiment, includes a checkers board design 270, as exemplified in FIG. 22. In one embodiment, the checkers board design 270 is laminated to the top surface of the table top 230. In another such embodiment, the checkers board design 270 is imprinted on the smooth top playing surface 248. In yet another embodiment, the checkers board design 270 is integrally formed within the smooth top playing surface 248. In a preferred embodiment, the smooth top playing surface 248 features markings 268 comprising a train track design 272, as exemplified in FIG. 22. In another embodiment, the smooth top playing surface 248 features markings 268 designed for card playing games, such as poker, blackjack, rummy, or crazy eights. Moreover, in embodiments of the invention having a smooth top playing surface 248, the childrens activity table (e.g., 100, 200) is configured for use as an arts and crafts table, a snack table, and/or a general game table for children's board games.

In one embodiment, a plurality of fasteners 262 (such as wood screws, for example) connect the first elongated mounting plate 208 to the first leg 202, as exemplified in FIG. 13. Similarly, a plurality of fasteners 262 (such as wood screws, for example) connect the second elongated mounting plate 210 to the first leg 202. In another embodiment, they are respectively connected with glue or resin. In yet another embodiment, the first elongated mounting plate 208 and the second elongated mounting plate 219 are integrally formed with the first leg 202 as a unitary construction, such as through plastic molding. While the first leg 202 is exemplified as having a primarily elongated rectangular or square shape (i.e., a square cross-section) embodiments of the invention also include legs (e.g., 202) that respectively have an elongated cylindrical shape (i.e., a round cross-section) (meaning, for instance a round leg). And further, other embodiments include legs (e.g., 202) that respectively have a tapered shape.

Similarly, in one embodiment, the first elongated apron plate 218 and the second elongated apron plate 226 are respectively connected to the at least first apron 216 and the at least second apron 224 with a plurality of fasteners 262 (such as wood screws, for example), as illustrated in FIG. 11. In another embodiment, the first elongated apron plate 218 and the second elongated apron plate 226 are connected to the at least first apron 216 and the at least second apron 224 with glue or resin. In yet another embodiment, the at least a first elongated apron plate 218 and the at least a second elongated apron plate 226 are fabricated with the at least a first apron 216 and the at least a second apron 224 as a unitary construction, such as, for example, through plastic molding.

Figure 18:
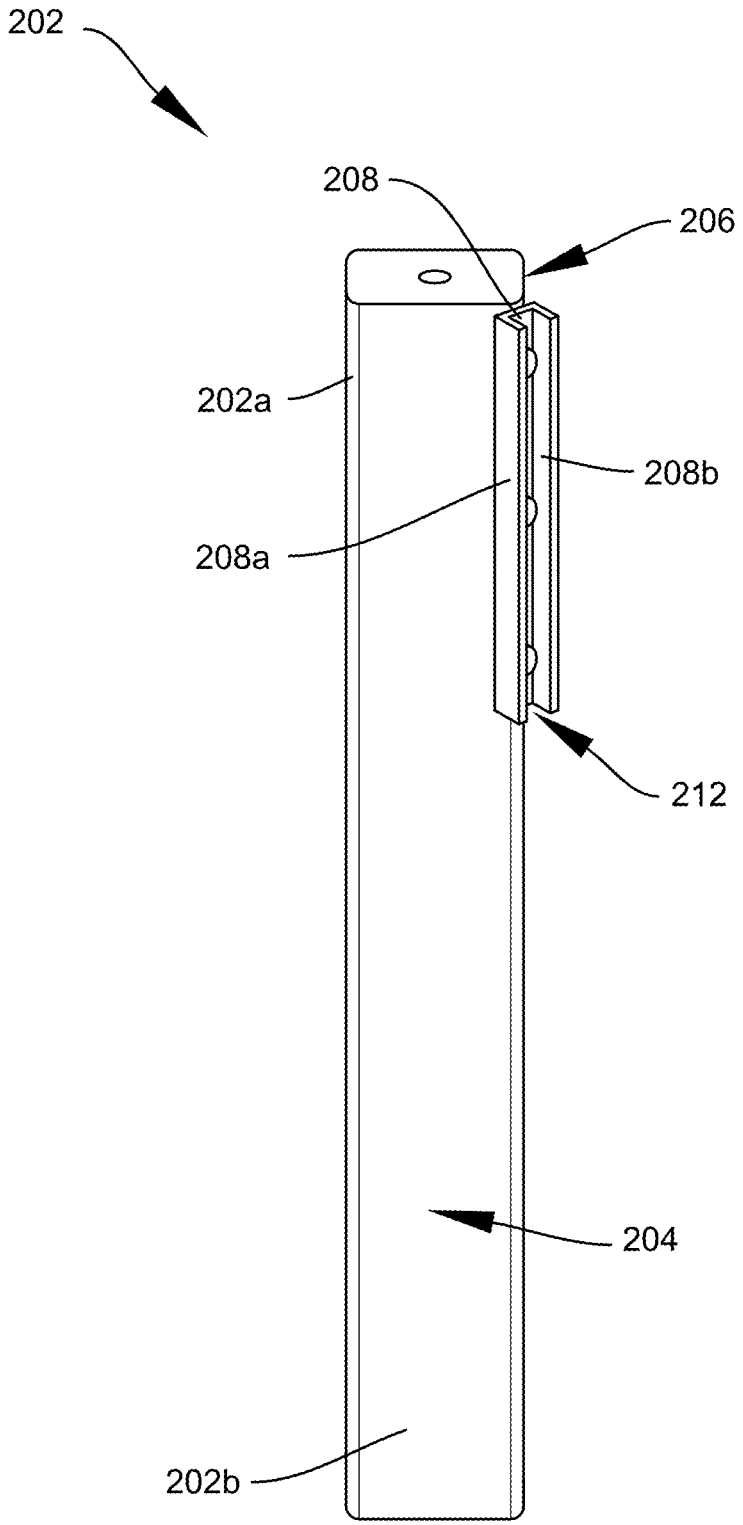
FIG. 18 illustrates a front perspective view of a first leg of the childrens activity table of FIG. 17, in accordance with embodiments of the invention.

Referring to FIGS. 17-20, there is further provided herein a childrens activity table 200 comprising at least a first leg 202 having a first side surface 204 preferably perpendicular to a second side surface 206 at a first corner 250, and the first corner 250 includes a first elongated mounting plate 208 extending outwardly therefrom, as exemplified in FIG. 18.

Referring to FIG. 18, the first elongated mounting plate 208 has a first elongated annular rail 208*a* spaced apart in a non-parallel orientation to a second elongated annular rail 208*b*. The first elongated annular rail 208*a* and the second elongated annular rail 208*b* form an annular pocket 212.

In one embodiment, the first elongated annular rail 208*a* and the second elongated annular rail 208*b* collectively form a single annular pocket 212 at the first corner 250 of the at least first leg 202, such that the first corner 250 does not include any other means of connection to the childrens activity table apart from the single annular pocket 212.

Figure 19:
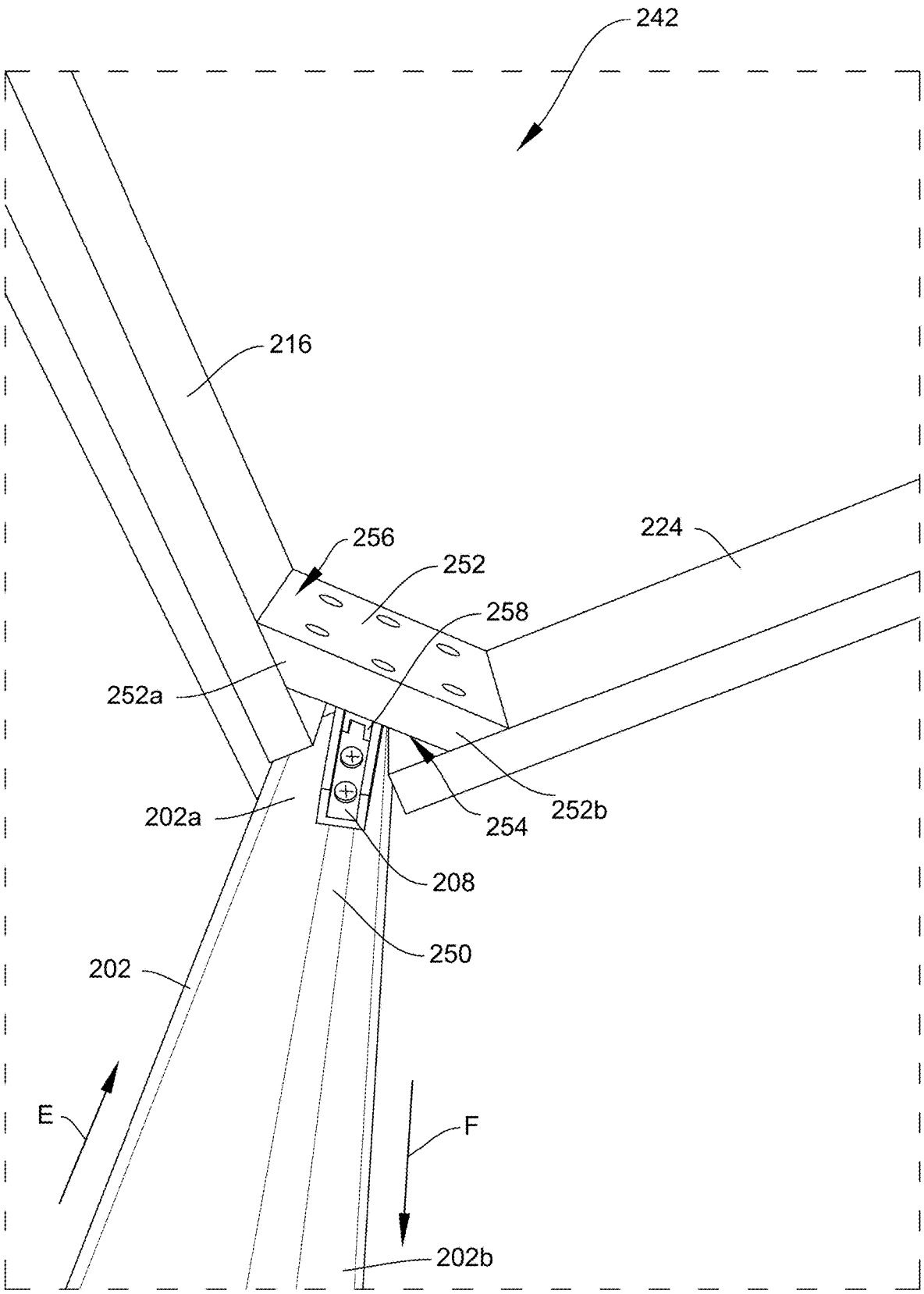
FIG. 19 illustrates a left back bottom perspective view of the childrens activity table, in accordance with embodiments of the invention.

Referring to FIGS. 17 and 19-20, the childrens activity table 200 includes a first apron 216 disposed perpendicular to a second apron 224. The childrens activity table 200 includes an apron corner support bracket 252 having a first end 252*a* opposite a second end 252*b*. The first end 252*a* is fixed to the first apron 216, and the second end is fixed to the second apron 224.

As shown in FIGS. 17 and 19, the apron corner support bracket 252 has an outer surface 254 opposite an inner surface 256. The apron corner support bracket 252 includes an elongated mounting plate 258 that is disposed on the outer surface 254 of the apron corner support bracket 252. The apron corner bracket 252 has a vertical plane 252V that intersects the vertical plane of the at least first apron 216 and also intersects the vertical plane of the at least second apron 224 at a point of intersection between the vertical plane of the at least first apron 216 and the vertical plane of the at least second apron 224.

In the upstanding table position, the first side surface 204 of the first leg 202 has a vertical plane that is parallel to the vertical plane of the at least first apron 216. And the second side surface 206 of the first leg 202 has a vertical plane that is parallel to the vertical plane of the at least second apron 224, as shown in FIGS. 17 and 19. In other words, the apron corner support bracket 252 connects the first apron 216 to the second apron 224.

Referring to FIG. 19, the elongated mounting plate 258 has elongated annular rails 258*a*,258*b* that are spaced apart in a non-parallel orientation which form an annular mounting bracket 260 (shown in FIG. 17), and the annular mounting bracket 260 is sized and configured to slidably engage into the annular pocket 212 of the first leg 202, as shown in FIG. 19, for an upstanding table position, as shown in FIG, 20.

The childrens activity table 200 includes a table top 230 comprising a planar body 232 connected to the first apron 216 and also connected to the second apron 224. In a preferred embodiment, the planar body 232 comprises a top surface 246 that is in coplanar alignment with a top surface of the first apron 216 and with a top surface of the second apron 224. An illustration of the top surface of the planar body 232 in coplanar alignment with the top surface of the first apron 216 and in coplanar alignment with the top surface of the second apron 224 is exemplified in FIG. 7 (where apron 216 is analogous to apron 130).

In a preferred embodiment, the planar body 232 of the table top 230 defines an opening 238 that is adapted to receive children's play toys 170 therethrough.

The childrens activity table 200 preferably includes a storage net 240 that is removably connected to a bottom surface 242 of the table top 230, and the storage net 240 is disposed beneath the opening 238. as illustrated in FIG. 20.

In another embodiment, the childrens activity table 200 includes a storage bin 180 that is removably connected to a bottom surface 242 of the table top 230, and the storage bin 180 is disposed beneath the opening 238 that is defined by the table top 230.

The storage bin 180 is attached to the bottom surface 242 of the table top 230 in the same manner as is illustrated in FIG. 8B.

The childrens activity table 200 preferably includes a table top 230 having a top playing surface 244 that includes a plurality of knobs 246 projecting perpendicularly from the top playing surface 244, and the plurality of knobs 246 are adapted for mating with interconnecting toys 170, as described above. In yet another preferred embodiment, the childrens activity table 200 includes a planar body 232 that defines at least two openings 168,238 adapted to receive children's play toys 170, in the same nature as is described in detail above.

In a similar nature to the description above, as shown, the opening 238 shown in FIG. 20 is preferably positioned at a center of the table top 230, and in FIG. 7, the opening 168 is shown as off-set from a center of the table top 162. It can be appreciated from this disclosure and description herein that, in one embodiment, the opening 238 of the childrens activity table 200 is offset from the center of the table top 230, in the same manner that the opening 168 is illustrated to be offset from the center of the table top in FIG. 7. Similarly, it can be appreciated from this disclosure and description herein that, in one embodiment, the opening 168 (FIG. 7) of the childrens activity table 100 is positioned at the center of the table top 162, in the same manner that the opening 238 is illustrated to be at the center of the table top 230 in FIG. 20. In addition, it can be appreciated from this disclosure and description herein that, in one embodiment, there are two openings 168 defined by the table top 162. In addition, it can be appreciated from this disclosure and description herein that, in one embodiment, there are two openings 168,238 defined by the table top 162. In another embodiment, there are two openings 168, 238 defined by the table top 230.

In one embodiment, the table top 230 has a smooth top playing surface 248. Such smooth top playing surface 248 is exemplified in FIGS. 17 and 21-23 where the top playing surface 244 does not contain the plurality of knobs 246 projecting perpendicularly from the top playing surface 244.

As shown in FIG. 18, the at least first leg 202 has a top section 202*a* opposite a bottom section 202*b*. As illustrated in FIG. 20, in a preferred embodiment, the childrens activity table 200 includes a second leg 203, a third leg 205, and a fourth leg 207. As can appreciated from the Figures and the description herein, in a preferred embodiment, the second leg 203, the third leg 205, and the fourth leg 207 are each identical in structure and components as the first leg 202, as illustrated in FIG. 18, each of which respectively corresponds with the illustrated aprons and respective components illustrated in FIG. 17 and FIG. 20. In a preferred embodiment, the second leg 203, third leg 205, and fourth leg 207 are each identical in structure and components as the first leg 202, as illustrated in FIG. 18, which corresponds with the aprons and respective components illustrated in FIGS. 17 and 20. As noted and described elsewhere herein, while the table top (e.g., 162, 230) in FIGS. 17 and 20 is exemplified as preferably having a rectangular shape, in another preferred embodiment, the table top has a (e.g., 162, 230) square shape. In other embodiments, the table top (e.g., 162, 230) has a round shape, and in other embodiments, the table top (e.g., 162, 230) has an oval shape. In other embodiments, the table top (e.g., 162, 230) has a triangular shape.

In one embodiment, a plurality of fasteners 262 (such as wood screws, for example) connect the elongated mounting plate 208 to the corner 250 of the first leg 202. In another embodiment, the elongated mounting plate 258 is connected to the apron corner support bracket 252 with glue or resin. In yet another embodiment, the elongated mounting plate 258 is fabricated with the apron corner support bracket 252 as a unitary construction, through plastic molding, for example.

In accordance with preferred embodiments of the inventions described above, each of the elongated mounting plates (e.g., 108, 110, 122, 124, 208, 210) and each of the elongated apron plates (e.g., 136, 138, 218, 226) are preferably fabricated out of steel or metal. Meaning, for instance, each one is preferably forged from steel, for example. Similarly, each elongated mounting plate (e.g., 258) is preferably fabricated out of steel or metal. In other embodiments, each of these components are fabricated out of plastic.

In a preferred embodiment, each leg 202, 203, 205, 207 of the childrens activity table 200 is fabricated out of wood. In another embodiment, each leg 202, 203, 205, 207 of the children's activity table 200 is fabricated out of plastic. In yet another embodiment, each leg 202, 203, 205, 207 of the children's activity table 200 is fabricated out of metal. In other embodiments, each of these components are fabricated out of plastic.

While preferred embodiments of the invention include a childrens activity table primarily fabricated with wood, each of the childrens activity tables described herein could be fabricated out of plastic or steel.

On other embodiments, the childrens activity table 100, 200 is fabricated out of one or more composite materials, including for example, ABS Plastic (Acrylonitrile Butadiene Styrene) Polypropylene (PP) Polyethylene (PE), PVC (Polyvinyl Chloride), Polycarbonate (PC), Nylon Polyurethane (PU) Foams, or Thermoplastic Elastomers (TPE).

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The invention claimed is:

1. A childrens activity table, comprising:

at least a first leg having a first side surface perpendicular to a second side surface, said first side surface comprising a first elongated arcuate mounting plate forged from steel, said second side surface comprising a second elongated arcuate mounting plate forged from steel, the first and second elongated arcuate mounting plates each having curved sides forming a respective first elongated rail spaced apart in a non-parallel orientation to a second elongated rail, the first elongated rail and the second elongated rail forming a first pocket and a second pocket, respectively, wherein said first and second elongated arcuate mounting plates each having an open top opposite an open bottom, respectively;

at least a first apron comprising at least a first elongated apron plate forged from steel, the at least first elongated apron plate having a pair of elongated rails extending outwardly on opposite sides thereof and spaced apart in a non-parallel orientation forming a first apron mounting bracket;

wherein said first apron mounting bracket is sized and configured to slidably engage into the first pocket for an upstanding table position;

at least a second apron comprising at least a second elongated apron plate forged from steel, the at least second elongated apron plate having a pair of elongated rails extending outwardly on opposite sides thereof and spaced apart in a non-parallel orientation forming a second apron mounting bracket, wherein said second apron mounting bracket is sized and configured to slidably engage into the second pocket for the upstanding table position; and a table top comprising a planar body disposed atop the at least first apron and the at least second apron in the upstanding table position.

2. The childrens activity table of claim 1, wherein the planar body is fixed to a top of the at least first apron and to a top of the at least second apron.

3. The childrens activity table of claim 2, wherein the planar body of the table top defines an opening adapted to receive children's play toys therethrough.

4. The childrens activity table of claim 3, further comprising a storage net removably connected to a bottom surface of the table top, said storage net disposed beneath the opening, said storage net adapted to receive and contain children's play toys.

5. The childrens activity table of claim 3, further comprising a storage bin removably connected to a bottom surface of the table top, said storage bin disposed beneath the opening, said storage bin adapted to receive and contain children's play toys.

6. The childrens activity table of claim 2, the table top comprising a top playing surface having a plurality of knobs projecting perpendicularly from the top playing surface, said plurality of knobs adapted for mating with interconnecting toys.

7. The childrens activity table of claim 2, the table top comprising a smooth top playing surface.

8. The childrens activity table of claim 7, said smooth top playing surface comprising markings, wherein said markings comprise a checkers board design.

9. The childrens activity table of claim 7, said smooth top playing surface comprising markings, wherein said markings comprise a train track board design.

10. The childrens activity table of claim 1, wherein the planar body of the table top defines at least two openings adapted to receive children's play toys therethrough.

* * * * *